US008028767B2

(12) United States Patent
Radford et al.

(10) Patent No.: US 8,028,767 B2
(45) **Date of Patent: *Oct. 4, 2011**

(54) EXPANDABLE STABILIZER WITH ROLLER REAMER ELEMENTS

(75) Inventors: Steven R. Radford, The Woodlands, TX (US); Timothy K. Marvel, The Woodlands, TX (US)

(73) Assignee: Baker Hughes, Incorporated, Houston, TX (US)

( * ) Notice: Subject to any disclaimer, the term of this patent is extended or adjusted under 35 U.S.C. 154(b) by 147 days.

This patent is subject to a terminal disclaimer.

(21) Appl. No.: 12/361,428

(22) Filed: Jan. 28, 2009

(65) Prior Publication Data

US 2009/0145666 A1 Jun. 11, 2009

Related U.S. Application Data

(63) Continuation-in-part of application No. 11/949,259, filed on Dec. 3, 2007, now Pat. No. 7,900,717.

(51) Int. Cl.
*E21B 7/28* (2006.01)

(52) U.S. Cl. ..... 175/269; 175/285

(58) Field of Classification Search ..... 175/268, 175/269, 267, 285, 291
See application file for complete search history.

(56) References Cited

U.S. PATENT DOCUMENTS

| | | | | |
|---|---|---|---|---|
| 1,548,578 | A | | 8/1925 | Blanchard |
| 1,678,075 | A | | 7/1928 | Phipps |
| 1,772,710 | A | | 8/1930 | Denney |
| 1,804,850 | A | | 5/1931 | Triplett |
| 1,906,427 | A | * | 5/1933 | Sievers et al. ..... 175/292 |
| 2,069,482 | A | | 2/1937 | Seay |
| 2,177,721 | A | | 10/1939 | Johnson et al. |
| 2,344,598 | A | | 3/1944 | Church |
| 2,758,819 | A | | 8/1956 | Kammerer, Jr. et al. |
| 2,799,479 | A | | 7/1957 | Kammerer |
| 2,882,019 | A | | 4/1959 | Carr et al. |

(Continued)

FOREIGN PATENT DOCUMENTS

EP 0594420 4/1994

(Continued)

OTHER PUBLICATIONS

Baker Hughes—Hughes Christensen, GuagePro XPR Expandable Reamer, 2008, pp. 1-2, www.HCCbits.com.

(Continued)

*Primary Examiner* — Daniel P Stephenson
*Assistant Examiner* — Blake Michener
(74) *Attorney, Agent, or Firm* — Locke Lord Bissell & Liddell LLP

(57) ABSTRACT

An expandable reamer apparatus for drilling a subterranean formation may include a tubular body, one or more blades, each blade positionally coupled to a sloped track of the tubular body, a push sleeve and a drilling fluid flow path extending through an inner bore of the tubular body for conducting drilling fluid therethrough. Each of the one or more blades may be configured to ream a subterranean formation. The push sleeve may be disposed in the inner bore of the tubular body and coupled to each of the one or more blades so as effect axial movement thereof along the track to an extended position responsive to exposure to a force or pressure of drilling fluid in the flow path of the inner bore. Each blade may include one or more roller elements for reaming a wellbore.

41 Claims, 24 Drawing Sheets

U.S. PATENT DOCUMENTS 3,105,562 A 10/1963 Stone et al.
3,123,162 A 3/1964 Rowley
3,126,065 A 3/1964 Chadderdon
3,211,232 A 10/1965 Grimmer
3,220,481 A 11/1965 Park
3,224,507 A 12/1965 Cordany et al.
3,320,004 A 5/1967 Garrett
3,332,498 A 7/1967 Page, Jr.
3,433,313 A 3/1969 Brown
3,753,471 A 8/1973 Kammerer, Jr. et al.
3,845,815 A 11/1974 Garwood
3,916,998 A 11/1975 Bass, Jr. et al.
4,055,226 A 10/1977 Weber
4,111,262 A 9/1978 Duncan
4,227,586 A 10/1980 Bassinger
4,304,311 A 12/1981 Shinn
4,440,222 A 4/1984 Pullin
4,456,080 A 6/1984 Holbert
4,458,761 A 7/1984 Van Vreeswyk
4,540,941 A 9/1985 Walkow
4,565,252 A 1/1986 Campbell et al.
4,635,738 A 1/1987 Schillinger et al.
4,660,657 A 4/1987 Furse et al.
4,693,328 A 9/1987 Furse et al.
4,711,326 A 12/1987 Baugh et al.
4,842,083 A 6/1989 Raney
4,877,092 A 10/1989 Helm et al.
4,889,197 A 12/1989 Boe
5,139,098 A 8/1992 Blake
5,175,429 A 12/1992 Hall, Jr. et al.
5,211,241 A 5/1993 Mashaw, Jr. et al.
5,211,541 A 5/1993 Fledderjohn et al.
5,265,684 A 11/1993 Rosenhauch
5,293,945 A 3/1994 Rosenhauch et al.
5,305,833 A 4/1994 Collins
5,318,131 A 6/1994 Baker
5,318,137 A 6/1994 Johnson et al.
5,318,138 A 6/1994 Dewey et al.
5,332,048 A 7/1994 Underwood et al.
5,343,963 A 9/1994 Bouldin et al.
5,368,114 A 11/1994 Tandberg et al.
5,375,662 A 12/1994 Echols, III et al.
5,402,856 A 4/1995 Warren et al.
5,402,859 A 4/1995 Boberg et al.
5,413,180 A 5/1995 Ross et al.
5,437,308 A 8/1995 Morin et al.
5,443,129 A 8/1995 Bailey et al.
5,495,899 A 3/1996 Pastusek et al.
5,497,842 A 3/1996 Pastusek et al.
5,518,073 A 5/1996 Manke et al.
5,558,162 A 9/1996 Manke et al.
5,560,440 A 10/1996 Tibbitts
5,647,437 A 7/1997 Braddick et al.
5,740,864 A 4/1998 De Hoedt et al.
5,746,274 A 5/1998 Voll et al.
5,765,653 A 6/1998 Doster et al.
5,788,000 A 8/1998 Maury et al.
5,823,254 A 10/1998 Dobson et al.
5,853,054 A 12/1998 McGarian et al.
5,862,870 A 1/1999 Hutchinson
5,957,223 A 9/1999 Doster et al.
5,992,518 A 11/1999 Whitlock
6,059,051 A 5/2000 Jewkes et al.
6,070,677 A 6/2000 Johnston, Jr.
RE36,817 E 8/2000 Pastusek et al.
6,131,662 A 10/2000 Ross
6,131,675 A 10/2000 Anderson
6,179,066 B1 1/2001 Nasr et al.
6,213,226 B1 4/2001 Eppink et al.
6,227,312 B1 5/2001 Eppink et al.
6,289,999 B1 9/2001 Dewey et al.
6,325,151 B1 12/2001 Vincent et al.
6,328,117 B1 12/2001 Berzas et al.
6,360,831 B1 3/2002 Akesson et al.
6,378,632 B1 4/2002 Dewey et al.
6,494,272 B1 12/2002 Eppink et al.
6,499,537 B1 12/2002 Dewey et al.
6,615,933 B1 9/2003 Eddison
6,651,756 B1 11/2003 Overstreet et al.
6,668,936 B2 12/2003 Williamson, Jr. et al.
6,668,949 B1 12/2003 Rives
6,695,080 B2 2/2004 Presley et al.
6,702,020 B2 3/2004 Zachman et al.
6,732,817 B2 5/2004 Dewey et al.
6,739,416 B2 5/2004 Presley et al.
6,880,650 B2 4/2005 Hoffmaster et al.
6,886,633 B2 5/2005 Fanuel
6,920,930 B2 7/2005 Allamon et al.
6,920,944 B2 7/2005 Eppink et al.
6,991,046 B2 1/2006 Fielder et al.
7,021,389 B2 4/2006 Bishop et al.
7,036,611 B2 5/2006 Radford et al.
7,048,078 B2 5/2006 Dewey et al.
7,069,775 B2 7/2006 Fredette et al.
7,083,010 B2 8/2006 Eppink et al.
7,100,713 B2 9/2006 Tulloch
7,234,542 B2 6/2007 Vail, III
7,252,163 B2 8/2007 Ollerenshaw et al.
7,287,603 B2 10/2007 Hay et al.
7,293,616 B2 11/2007 Tulloch
7,308,937 B2 12/2007 Radford et al.
7,314,099 B2 1/2008 Dewey et al.
7,325,630 B2 * 2/2008 Takhaundinov et al. ..... 175/269
7,451,836 B2 11/2008 Hoffmaster et al.
7,493,971 B2 2/2009 Nevlud et al.
7,506,703 B2 3/2009 Campbell et al.
7,513,318 B2 4/2009 Underwood et al.
7,549,485 B2 6/2009 Radford et al.
7,658,241 B2 2/2010 Lassoie et al.
7,665,545 B2 * 2/2010 Telfer ..... 175/57
2001/0045304 A1 11/2001 Molloy
2003/0029644 A1 2/2003 Hoffmaster et al.
2003/0155155 A1 8/2003 Dewey et al.
2004/0134687 A1 * 7/2004 Radford et al. ..... 175/57
2004/0222022 A1 11/2004 Nevlud et al.
2005/0145417 A1 7/2005 Radford et al.
2005/0241856 A1 11/2005 Lassoie et al.
2005/0274546 A1 12/2005 Fanuel et al.
2005/0284659 A1 * 12/2005 Hall et al. ..... 175/27
2006/0113113 A1 6/2006 Underwood et al.
2006/0118339 A1 * 6/2006 Takhaundinov et al. ..... 175/267
2006/0124317 A1 6/2006 Telfer
2006/0144623 A1 7/2006 Ollerensaw et al.
2006/0207801 A1 9/2006 Clayton
2006/0249307 A1 11/2006 Ritter et al.
2007/0017707 A1 1/2007 Fanuel et al.
2007/0089912 A1 4/2007 Eddison et al.
2007/0163808 A1 7/2007 Campbell et al.
2008/0017419 A1 1/2008 Cooley et al.
2008/0105464 A1 5/2008 Radford
2008/0110678 A1 5/2008 Radford et al.
2008/0128169 A1 6/2008 Radford et al.
2008/0128174 A1 6/2008 Radford et al.
2008/0128175 A1 6/2008 Radford et al.
2008/0245576 A1 10/2008 Liang et al.
2009/0114448 A1 5/2009 Laird et al.
2009/0145666 A1 6/2009 Radford et al.
2009/0242277 A1 10/2009 Radford et al.

FOREIGN PATENT DOCUMENTS

EP 1188898 3/2002
EP 1614852 1/2006
GB 2420803 6/2006
GB 2393461 10/2006
GB 2426269 2/2007
RU 2172385 3/2000
WO WO 2004106694 A1 * 12/2004
WO 2007017651 2/2007

OTHER PUBLICATIONS

Dong Jin Kim, International Search Report for International Patent Application No. US/2010/022165, Korean Intellectual Property Office, dated Aug. 2, 2010.

Dong Jin Kim, Written Opinion for International Patent Application No. US/2010/022165, Korean Intellectual Property Office, dated Aug. 2, 2010.

Thomson, I., Radford, S., Powers, J., Shale, L. and Jenkins, M. "A Systematic Approach to a Better Understanding of the Concentric Hole-Opening Process Utilizing Drilling Mechanics and Drilling Dynamics Measurements Recorded Above and Below the Reamer." IADC/SPE 112647, 2008 IADC/SPE Drilling Conference, Mar. 4-6, 2008, Orlando, Florida.
Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Aug. 25-27, 2008, Indonesia.
International Search Report for International Patent Application No. PCT/US2010/025867 mailed Oct. 15, 2010, 3 pages.
International Written Opinion for International Patent Application No. PCT/US2010/025867 mailed Oct. 15 2010, 6 pages.
PCT International Search Report for International Patent Application No. PCT/US2007/024795, mailed May 28 2008.
PCT International Search Report for International Patent Application No. PCT/US2009/038194, mailed Nov. 9, 2009.
PCT International Search Report for International Patent Application No. PCT/US2009/042511, mailed Dec. 1 2009.
International Search Report for International Patent Application No. PCT/US2007/024796, dated Jul. 11, 2008, 7 pages.
Written Opinion of the International Searching Authority for International Patent Application No. PCT/US2007/024796, dated Jul. 11, 2008, 10 pages.
Radford, Steven, et al., "Novel Concentric Expandable Stabilizer Results in Increased Penetration Rates and Drilling Efficiency with Reduced Vibration", SPE/IADC 119534, prepared for presentation at the SPE/IADC Drilling Conference and Exhibition held in Amsterdam, The Netherlands, Mar. 17-19, 2009, 13 pages.
Merriam-Webster Dictionary, Definitions of "Retain" and "Keep" accessed May 20, 2010 from www.merriam-webster.com.
U.S. Appl. No. 12/416,386, filed Apr. 1, 2009, entitled "Compound Engagement Profile on a Blade of a Down-Hole Stabilizer and Methods Therefor," by Radford et al.
U.S. Appl. No. 12/058,384, filed Mar. 28, 2008, entitled "Stabilizer and Reamer System Having Extensible Blades and Bearing Pads and Method of Using Same," by Radford et al.
U.S. Appl. No. 12/501,688, filed Jul. 13, 2009, entitled "Stabilizer Ribs on Lower Side of Expandable Reamer Apparatus to Reduce Operating Vibration," by Radford et al.

* cited by examiner

EXPANDABLE STABILIZER WITH ROLLER REAMER ELEMENTS

CROSS REFERENCE TO RELATED APPLICATIONS

This application is a continuation-in-part of nonprovisional patent application Ser. No. 11/949,259, filed on Dec. 3, 2007, which is currently pending and which claims priority to provisional patent application No. 60/872,744, filed on Dec. 4, 2006, each of which is assigned to the assignee of the present invention and incorporated herein by reference in their entireties for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to an expandable reamer apparatus for reaming a subterranean borehole; and more specifically relate to reaming a subterranean borehole beneath a casing or liner.

2. Description of the Related Art

Expandable reamers are typically employed for enlarging subterranean borehole. Conventionally in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent crossflow of formation fluids, and to enable control of formation fluid and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, assigned to the assignee of the present invention. A bi-center bit assembly employs two longitudinally superimposed bit sections with laterally offset axes, which when rotated produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom hole assembly with a pilot drill bit at the distal end thereof and a reamer assembly some distance above. This arrangement permits the use of any standard rotary drill bit type, be it a rock bit, drag bit or other bit as the pilot bit. The extended nature of the assembly permits greater flexibility when passing through tight spots in the borehole as well as the opportunity to effectively stabilize the pilot drill bit so that the pilot hole and the following reamer will traverse the path intended for the borehole. This aspect of an extended bottom hole assembly is particularly significant in directional drilling. The assignee of the present invention has, to this end, designed as reaming structures so called "reamer wings," which generally comprise a tubular body having a fishing neck with a threaded connection at the top thereof and a tong die surface at the bottom thereof also with a threaded connection. U.S. Pat. Nos. 5,497,842 and 5,495,899, both assigned to the assignee of the present invention, disclose reaming structures including reamer wings. The upper midportion of the reamer wing tool includes one or more longitudinally extending blades projecting generally radially outwardly from the tubular body, the outer edges of the blades carrying PDC cutting elements.

As mentioned above, conventional expandable reamers may be used to enlarge a subterranean borehole and may include blades pivotably or hingedly affixed to a tubular body and actuated by way of a piston disposed therein as disclosed by U.S. Pat. No. 5,402,856 to Warren. In addition, U.S. Pat. No. 6,360,831 to Akesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the bore diameter may be increased below the casing.

The blades of conventional expandable reamers have been sized to minimize a clearance between themselves and the tubular body in order to prevent any drilling mud and earth fragments from becoming lodged in the clearance and binding the blade against the tubular body. The blades of these conventional expandable reamers utilize pressure from inside the tool to apply force radially outward against pistons that move the blades, carrying cutting elements, laterally outward. It is felt by some that the nature of the conventional reamers allows misaligned forces to cock and jam the pistons and blades, preventing the springs from retracting the blades laterally inward. Also, designs of these conventional expandable reamer assemblies may fail to help blade retraction when jammed and pulled upward against the borehole casing. Furthermore, some conventional hydraulically actuated reamers utilize expensive seals disposed around a very complex shaped and expensive piston, or blade, carrying cutting elements. In order to prevent cocking, some conventional reamers are designed having the piston shaped oddly in order to try to avoid the supposed cocking, requiring matching, or complex seal configurations. These seals may possibly leak after extended usage.

Other conventional reamers require very close tolerances (such as six-thousandths of an inch (0.006") in some areas) around the pistons or blades. Testing suggests that this may be a major contributor to the problem of the piston failing to retract the blades back into the tool, due to binding caused by particulate-laden drilling mud.

Notwithstanding the various prior approaches to drill and/or ream a larger diameter borehole below a smaller diameter borehole, the need exists for improved apparatus and methods for doing so. For instance, bi-center and reamer wing assemblies are limited in the sense that the pass through diameter of such tools is nonadjustable and limited by the reaming diameter. Furthermore, conventional bi-center and eccentric bits may have the tendency to wobble and deviate from the path intended for the borehole. Conventional expandable reaming assemblies, while sometimes more stable than bi center and eccentric bits, may be subject to damage when passing through a smaller diameter borehole or casing section, may be prematurely actuated, or may present difficulties in removal from the borehole after actuation.

Alternatively, expandable reamers may be used in other reaming applications wherein enlarging the borehole may not be the primary objective, or an objective at all. Expandable reamers may be used as stabilizers, centralizers, or for other purposes downhole wherein contact with the borehole wall may be expected or desired. As mentioned above, an expandable reamer may be useful in its retracted state for traveling to a desired location downhole, wherein the reamer may then be expanded. While a reamer may thereafter be used to enlarge the borehole wall, as described above, it need not be. For example, the blades of the reamer may not have cutting elements thereon and may contact the borehole wall in an effort to stabilize or centralize other downhole equipment. However, as the reamer rotates downhole, the blades may drag against the borehole wall producing friction in the radial and/or axial direction.

With respect to the radial direction, prior approaches to reamers or well drilling tools have included rolling elements disposed about the outer surface of the tools. For example, U.S. Pat. No. 4,227,586 to Bassinger discloses a "roller reamer assembly for mounting . . . in a reamer body and having longitudinally slideable bearing blocks . . . ." As another example, U.S. Pat. No. 4,693,328 to Furse et al. discloses a "three roller centralizer" that "is expandable from a position with the rollers retracted to a position with the rollers extended to a larger diameter for remaining concentric in a hole being underreamed." However, conventional reamers such as these may exhibit shortcomings such as those discussed above, for example, binding or failing to retract.

Accordingly, notwithstanding the prior approaches, there is an ongoing desire to improve or extend performance of an expandable reamer apparatus regardless of the type of subterranean formation being drilled or reamed. There is a further desire to provide a reamer apparatus that provides fail-safe blade retraction, is robustly designed with conventional seal or sleeve configurations, and may not require sensitive tolerances between moving parts. There is a further desire to provide such a reamer apparatus that minimizes radial torque and friction resulting from rotation downhole.

The inventions disclosed and taught herein are directed to an improved system for reaming subterranean wellbores, and to the methods associated therewith.

BRIEF SUMMARY OF THE INVENTION

In order to prevent, or at least substantially eliminate jamming of the blades carrying cutting elements for enlarging a bore hole, an apparatus is provided in at least one embodiment of the invention having blades configured to slide up a track in the body of the apparatus, enabling higher forces to open the blades of the apparatus to achieve a fully extended position without damage or binding, while allowing the blades to be retracted directly along the track.

In other embodiments of the invention, an expandable reamer apparatus for reaming a subterranean formation is provided that includes a tubular body, one or more blades positionally coupled to the track of the tubular body, a push sleeve and a drilling fluid flow path extending through the tubular body for conducting drilling fluid therethrough. The tubular body includes a longitudinal axis, an inner bore, an outer surface, and at least one track communicating through the tubular body between the inner bore and the outer surface, the track exhibiting a slope at an acute angle to the longitudinal axis. The one or more blades each include at least one cutting element configured and oriented to remove material from the wall of a borehole of a subterranean formation to enlarge the borehole diameter responsive to rotation of the apparatus. The push sleeve is positionally coupled to the inner bore of the tubular body and coupled to at least one blade so as to be configured to selectively allow communication of drilling fluid passing through the tubular body to effect axial movement thereof responsive to a force or pressure of drilling fluid so as to transition the at least one blade along the track from a retracted position into an extended position for reaming.

Other embodiments of the expandable reamer apparatus are provided. In at least one embodiment, one or more blades may include one or more roller reamer elements for reaming a wellbore. Each roller element may contact the borehole wall when the blades are in one or more positions, which may stabilize or centralize downhole equipment. The blades may, but need not, remove material during reaming operations.

DETAILED DESCRIPTION

Figure 1:
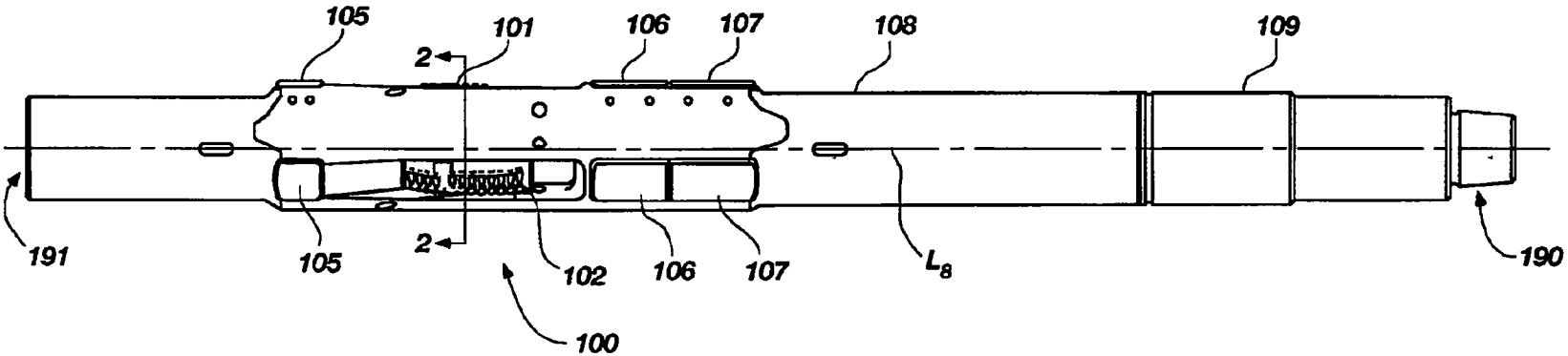
FIG. 1 illustrates a side view of one of many embodiments of an expandable reamer apparatus utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally. The terms "ream," "reamed," "reaming," "reamer," and like terms are used broadly herein and can include, without limitation, any manipulation of, contact with or communication with a subterranean wellbore or portion thereof, directly or indirectly, constantly or intermittently, intentionally or unintentionally, and can, but need not, include enlarging a wellbore, removal of wellbore, formation or other materials, or contact with downhole materials, trimming, crushing, pressing, drilling or other downhole processes, or one or more of the above, singularly or in combination. Reaming may occur in any direction and, while reaming may include enlarging a wellbore, it does not require it.

Applicants have created an expandable reamer apparatus for reaming a subterranean formation, which may include a tubular body and one or more blades. Each blade may be positionally coupled to a sloped track of the tubular body and the reamer may include a push sleeve and a drilling fluid flow path extending through an inner bore of the tubular body for conducting drilling fluid therethrough. Each of the one or more blades may, but need not, include at least one cutting element configured to remove material from a subterranean formation during reaming. Alternatively, each blade may be smooth, contoured, may lack cutting elements, or may include roller elements. The roller elements may be any type required by a particular application, such as smooth or contoured, and may, but need not, include cutting elements, inserts or other elements coupled thereto. The push sleeve may be disposed in the inner bore of the tubular body and may be coupled to one or more of the blades, such as to effect axial movement thereof along the track to an extended position responsive to exposure to a force or pressure, for example, of drilling or other fluid that may be in the flow path of the inner bore. Other embodiments of the expandable reamer apparatus are also provided. The illustrations presented herein are, in some instances, not actual views of any particular reamer tool, cutting element, or other feature of a reamer tool, but are merely idealized representations that are employed to describe the present invention. Additionally, elements common between figures may retain the same numerical designation.

FIG. 1 illustrates a side view of one of many embodiments of an expandable reamer apparatus 100 utilizing certain aspects of the present inventions. The expandable reamer apparatus 100 may include a generally cylindrical tubular body 108 having a longitudinal axis L.sub.8. The tubular body 108 of the expandable reamer apparatus 100 may have a lower end 190 and an upper end 191. The terms "lower" and "upper," as used herein with reference to the ends 190, 191, refer to the typical positions of the ends 190, 191 relative to one another when the expandable reamer apparatus 100 is positioned within a wellbore. The lower end 190 of the tubular body 108 of the expandable reamer apparatus 100 may include a set of threads (e.g., a threaded male pin member) for connecting the lower end 190 to another section of a drill string or another component, such as of a bottom-hole assembly (BHA), such as, for example, a drill collar or collars carrying a pilot drill bit for drilling a well bore. Similarly, the upper end 191 of the tubular body 108 of the expandable reamer apparatus 100 may include a set of threads (e.g., a threaded female box member) for connecting the upper end 191 to another section of a drill string or another component of a bottom-hole assembly (BHA).

Figure 17:
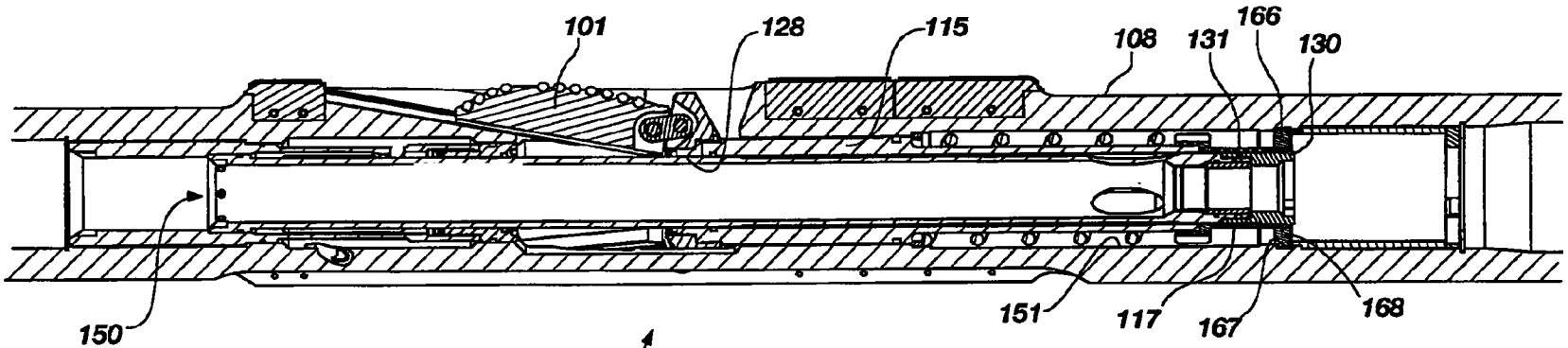
FIG. 17 illustrates a partial, longitudinal cross-sectional illustration of one or many embodiments of an expandable reamer apparatus in a closed, or retracted, initial tool position and utilizing certain aspects of the present inventions.

Three sliding cutter blocks or blades 101, 102, 103 (see FIG. 2) are positionally retained in circumferentially spaced relationship in the tubular body 108 as further described below and may be provided at a position along the expandable reamer apparatus 100 intermediate the first lower end 190 and the second upper end 191. The blades 101, 102, 103 may be comprised of steel, tungsten carbide, a particle-matrix composite material (e.g., hard particles dispersed throughout a metal matrix material), or other suitable materials as known in the art. The blades 101, 102, 103 are retained in an initial, retracted position within the tubular body 108 of the expandable reamer apparatus 100 as illustrated in FIG. 17, but may be moved responsive to application of hydraulic pressure into the extended position (shown in FIG. 22) and moved into a retracted position (shown in FIG. 23) when desired, as will be described herein. The expandable reamer apparatus 100 may be, but need not be, configured such that the blades 101, 102, 103 engage the walls of a subterranean formation surrounding a well bore in which apparatus 100 is disposed to remove formation material when the blades 101, 102, 103 are in the extended position, but may not be operable to so engage the walls of a subterranean formation within a well bore when the blades 101, 102, 103 are in the retracted position. While the expandable reamer apparatus 100 includes three blades 101, 102, 103, it is contemplated that one, two or more than three blades may be utilized to advantage. Moreover, while the blades 101, 102, 103 are symmetrically circumferentially positioned axially along the tubular body 108, the blades may also be positioned circumferentially asymmetrically as well as asymmetrically along the longitudinal axis L.sub.8 in the direction of either end 190 and 191.

Figure 2:
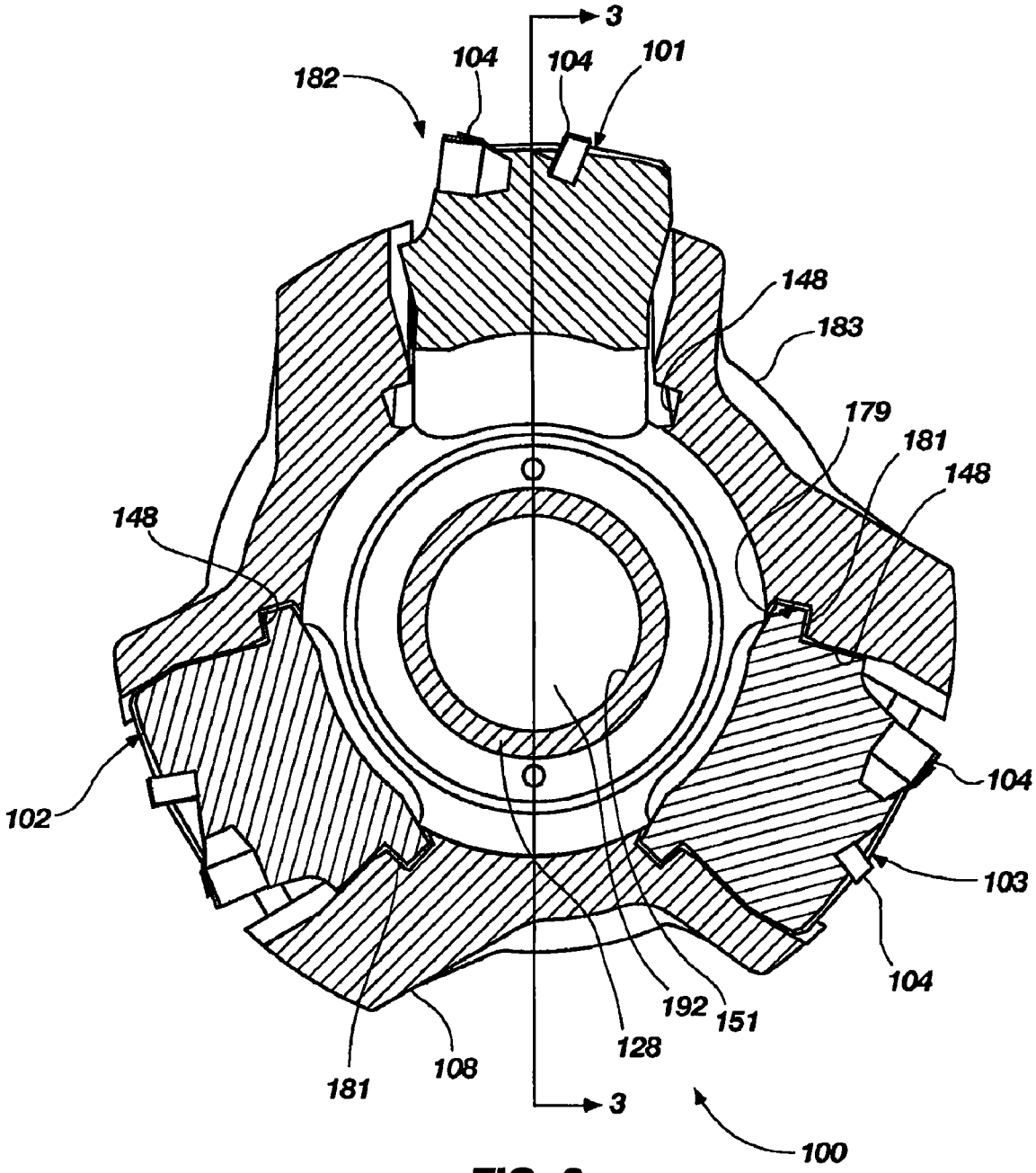
FIG. 2 illustrates a transverse cross-sectional view of the expandable reamer apparatus as indicated by section line 2-2 in FIG. 1 and utilizing certain aspects of the present inventions.

FIG. 2 illustrates a transverse cross-sectional view of the expandable reamer apparatus 100 as indicated by section line 2-2 in FIG. 1 and utilizing certain aspects of the present invention. The tubular body 108 may enclose a fluid passageway 192 that extends longitudinally through the tubular body 108. The fluid passageway 192 may direct fluid substantially through, for example, an inner bore 151 of a traveling sleeve 128 in bypassing relationship to substantially shield the blades 101, 102, 103 from exposure to drilling fluid, particularly in the lateral direction, or normal to the longitudinal axis L.sub.8. Advantageously, the particulate-entrained fluid may be less likely to cause build-up or interfere with the operational aspects of the expandable reamer apparatus 100 by shielding the blades 101, 102, 103 from exposure with the fluid. However, it is recognized that beneficial shielding of the blades 101, 102, 103 is not necessary to the operation of the expandable reamer apparatus 100 where, as explained in further detail below, the operation, i.e., extension from the initial position, the extended position and the retracted position, occurs by an axially directed force that is the net effect of the fluid pressure and spring biases forces. In this embodiment, which is but one of many, the axially directed force may directly actuate the blades 101, 102, 103 by axially influencing the actuating means, such as a push sleeve 115 (shown in FIG. 3) for example, and without limitation, as better described herein below.

Referring to FIG. 2, to better describe aspects of the invention blades 102 and 103 are shown in the initial or retracted positions, while blade 101 is shown in the outward or extended position. The expandable reamer apparatus 100 may be, but need not be, configured such that the outermost radial or lateral extent of each of the blades 101, 102, 103 is recessed within the tubular body 108 when in the initial or retracted positions so it may not extend beyond the greatest extent of outer diameter of the tubular body 108. Such an arrangement may protect the blades 101, 102, 103 as the expandable reamer apparatus 100 is disposed within a casing of a borehole, and may allow the expandable reamer apparatus 100 to pass through such casing within a borehole. In other embodiments, the outermost radial extent of the blades 101, 102, 103 may coincide with or slightly extend beyond the outer diameter of the tubular body 108. As illustrated by blade 101, the blades may extend beyond the outer diameter of the tubular body 108 when in the extended position, to engage the walls of a borehole in a reaming operation.

Figure 3:
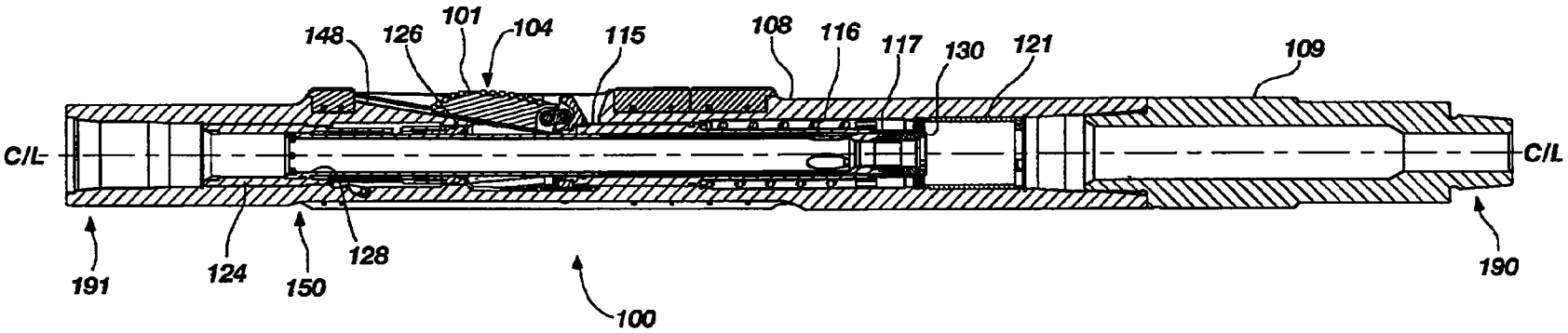
FIG. 3 illustrates a longitudinal cross-sectional view of the expandable reamer apparatus shown in FIG. 1 utilizing certain aspects of the present inventions.

FIG. 3 illustrates a longitudinal cross-sectional view of the expandable reamer apparatus shown in FIGS. 1 and 2 taken along section line 3-3 shown in FIG. 2 and utilizing certain aspects of the present invention. Reference may also be made to FIGS. 4-7, which show enlarged partial longitudinal cross-sectional views of various portions of the expandable reamer apparatus 100 shown in FIG. 3. Reference may also be made back to FIGS. 1 and 2 as desired. The tubular body 108 positionally respectively retains three sliding cutter blocks or blades 101, 102, 103 in three blade tracks 148. The blades 101, 102, 103 each may, but need not, carry a plurality of cutting elements 104 for engaging the material of a subterranean formation defining the wall of an open bore hole when the blades 101, 102, 103 are in an extended position (shown in FIG. 22). The cutting elements 104 may be polycrystalline diamond compact (PDC) cutters or other cutting elements known to a person of ordinary skill in the art and as generally described in U.S. Pat. No. 7,036,611 entitled "Expandable reamer apparatus for enlarging boreholes while drilling and methods of use," the entire disclosure of which is incorporated by reference herein.

Figure 8:
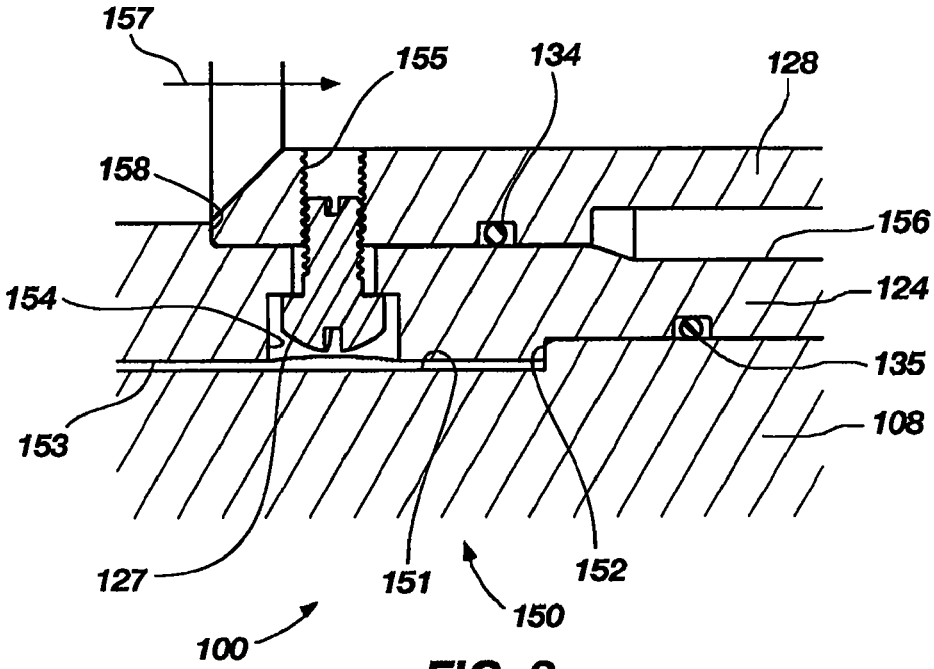
FIG. 8 illustrates a cross-sectional view of a shear assembly of one of many embodiments of an expandable reamer apparatus utilizing certain aspects of the present inventions.

The expandable reamer apparatus 100 may include a shear assembly 150 for retaining the expandable reamer apparatus 100 in the initial position by securing the traveling sleeve 128 toward the upper end 191 thereof. Reference may also be made to FIG. 8, showing a partial view of the shear assembly 150. The shear assembly 150 may include an uplock sleeve 124, some number of shear screws 127 and the traveling sleeve 128. The uplock sleeve 124 may be retained within an inner bore 151 of the tubular body 108 between a lip 152 and a retaining ring 132 (shown in FIG. 7), and may include an O-ring seal 135 to prevent fluid from flowing between the outer bore 153 of the uplock sleeve 124 and the inner bore 151 of the tubular body 108. The uplock sleeve 124 may include shear slots 154 for retaining each of the shear screws 127, where, in the current embodiment of the invention, each shear screw 127 may be threaded into a shear port 155 of the traveling sleeve 128. The shear screws 127 may hold the traveling sleeve 128 within the inner bore 156 of the uplock sleeve 124, such as to conditionally prevent the traveling sleeve 128 from axially moving in a downhole direction 157, i.e., toward the lower end 190 of the expandable reamer apparatus 100. The uplock sleeve 124 may include an inner lip 158 to prevent the traveling sleeve 128 from moving, for example, in the uphole direction 159, i.e., toward the upper end 191 of the expandable reamer apparatus 100. An O-ring seal 134 seals the traveling sleeve 128 between the inner bore 156 of the uplock sleeve 124. When the shear screws 127 are sheared, for example, the traveling sleeve 128 may be allowed to axially travel within the tubular body 108 in the downhole direction 157. Advantageously, the portions of the shear screws 127 when sheared are retained within the uplock sleeve 124 and the traveling sleeve 128, such as to prevent the portions from becoming loose or being lodged in other components when reaming the borehole. While shear screws 127 are shown, other shear elements may be used to advantage, for example, without limitation, a shear rod, a shear wire or a shear pin, singularly or in combination. Optionally, other shear elements may include structure for positive retention within constituent components after being exhausted, similar in manner to the shear screws 127 of the current embodiment of the invention.

Figure 6:
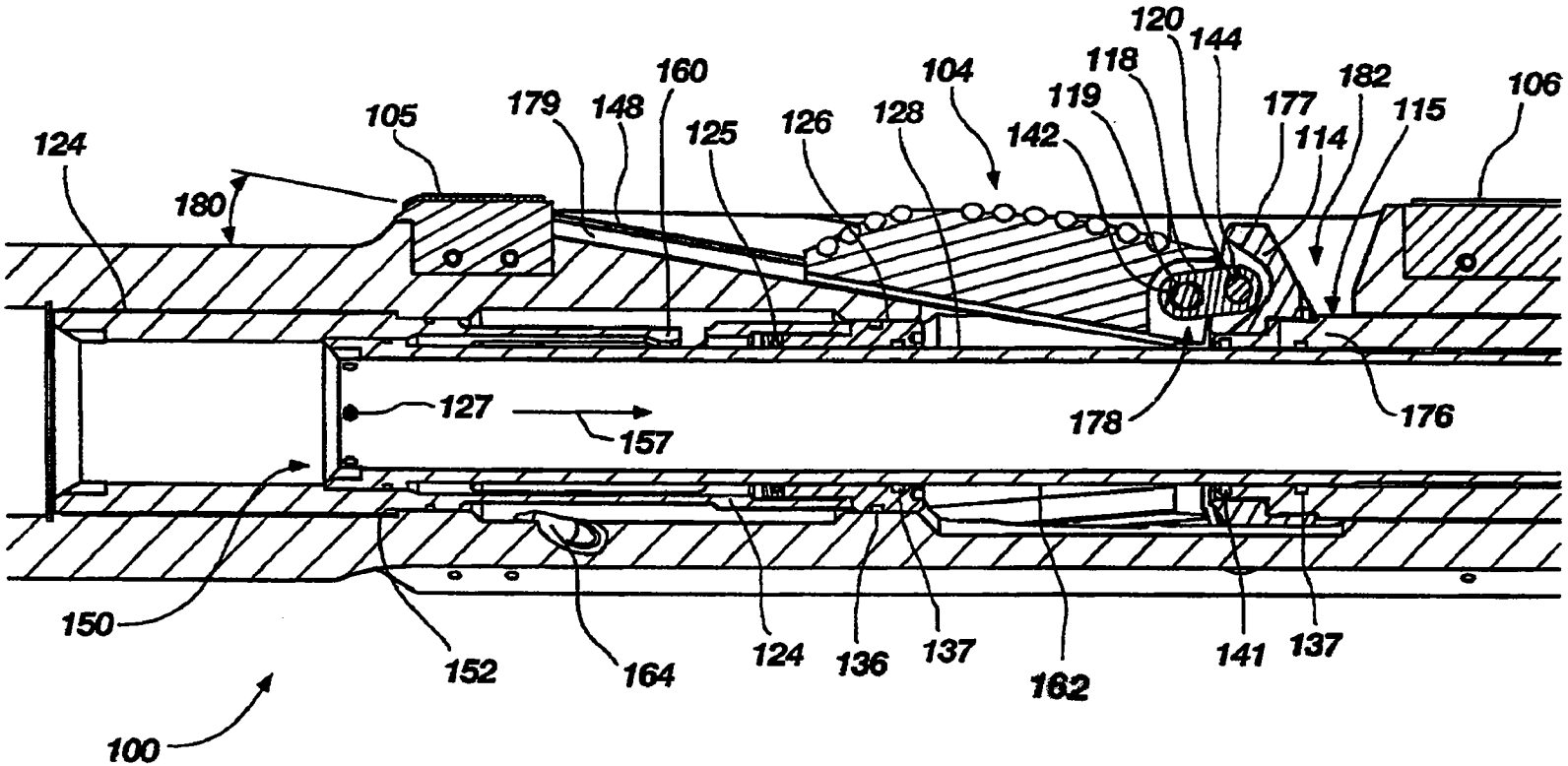
FIG. 6 illustrates an enlarged cross-sectional view of yet another portion of the expandable reamer apparatus shown in FIG. 3 utilizing certain aspects of the present inventions.
Figure 7:
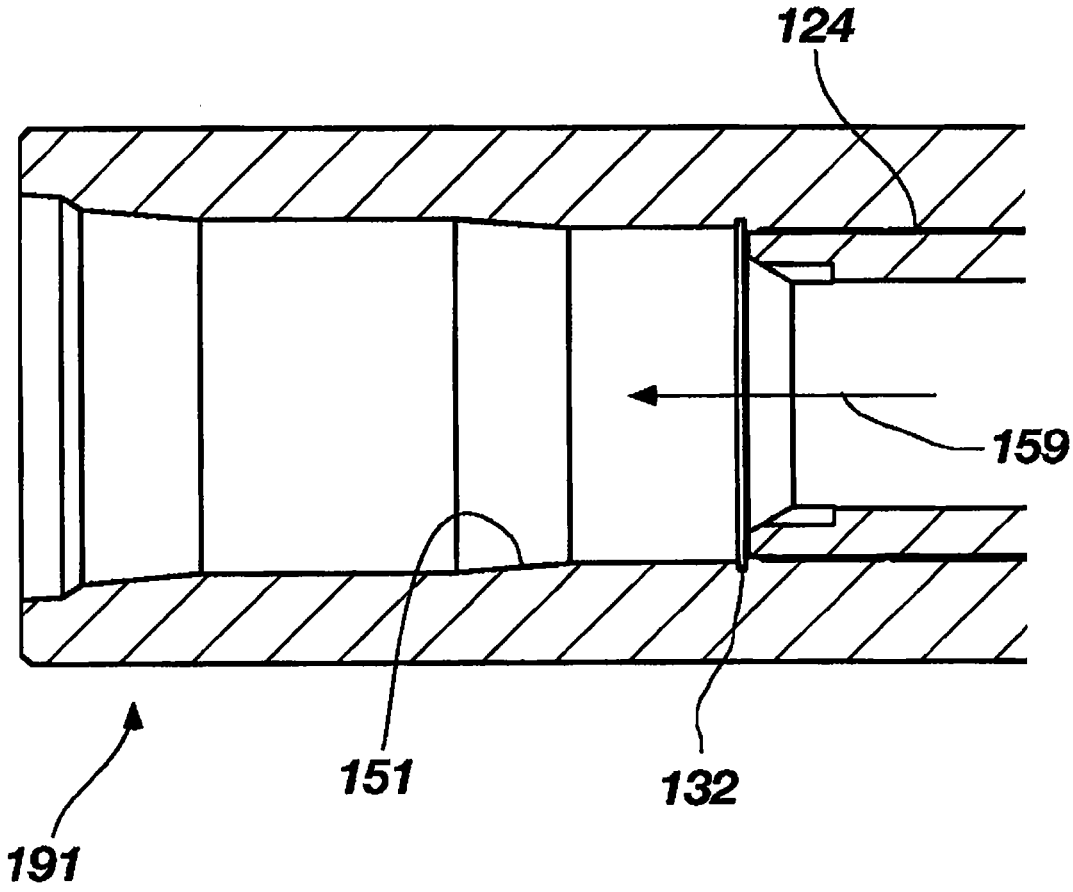
FIG. 7 illustrates an enlarged cross-sectional view of a further portion of the expandable reamer apparatus shown in FIG. 3 utilizing certain aspects of the present inventions.

With reference to FIG. 6, uplock sleeve 124 may further include a collet 160 that axially retains a seal sleeve 126 between the inner bore 151 of the tubular body 108 and an outer bore 162 of the traveling sleeve 128. The uplock sleeve 124 may also include one or more ears 163 and one or more ports 161 axially spaced there around. When the traveling sleeve 128 positions a sufficient axial distance in downhole direction 157, the one or more ears 163 may spring radially inward, such as to lock the motion of the traveling sleeve 128 between the ears 163 of the uplock sleeve 124 and between a shock absorbing member 125 mounted upon an upper end of the seal sleeve 126. Also, as the traveling sleeve 128 positions a sufficient axial distance in the downhole direction 157, the one or more ports 161 of the uplock sleeve 124 may be fluidly exposed, which may allow fluid to communicate with a nozzle intake port 164 from the fluid passageway 192. The shock-absorbing member 125 of the seal sleeve 126 may provide spring retention of the traveling sleeve 128 with the ears of the uplock sleeve 124 and may also mitigate impact shock, such as may be caused by the traveling sleeve 128 when its motion is stopped by seal sleeve 126.

Shock absorbing member 125 may comprise a flexible or compliant material, such as, for example, an elastomer or other polymer. In at least one embodiment, for example, shock-absorbing member 125 may comprise a nitrile rubber. Utilizing a shock-absorbing member 125 between the traveling sleeve 128 and seal sleeve 126 may reduce or prevent deformation of at least one of the traveling sleeve 128 and seal sleeve 126 that may otherwise occur due to impact therebetween.

It should be noted that any sealing elements or shock absorbing members disclosed herein that may be included within expandable reamer apparatus 100 may comprise any suitable material as known in the art, such as, for instance, a polymer or elastomer. Optionally, a material comprising a sealing element may be selected for relatively high temperature (e.g., about 400 degrees Fahrenheit or greater) use. For example, seals may be comprised of Teflon™, polyetheretherketone ("PEEK™") material, a polymer material, or an elastomer, or may comprise a metal to metal seal suitable for expected borehole conditions in accordance with a particular application. Specifically, any sealing element or shock absorbing member disclosed herein, such as shock absorbing member 125 and sealing elements 134 and 135, discussed hereinabove, or sealing elements, such as seal 136 discussed herein below, or other sealing elements included by an expandable reamer apparatus of the invention may comprise any material configured for relatively high temperature use, highly corrosive borehole environments, or any condition required by a particular application.

The seal sleeve 126 may include an O-ring seal 136, such as for sealing it between the inner bore 151 of the tubular body 108, and/or a T-seal seal 137, such as for sealing it between the outer bore 162 of the traveling sleeve 128, which may, but need not, complete fluid sealing between the traveling sleeve 128 and the nozzle intake port 164. Furthermore, the seal sleeve 126 may axially align, guide and/or support the traveling sleeve 128 within the tubular body 108, singularly or in combination. Moreover, the seal sleeve seals 136 and 137 may also prevent hydraulic fluid from leaking from within the expandable reamer apparatus 100 to outside the expandable reamer apparatus 100 by way of the nozzle intake port 164 prior to the traveling sleeve 128 being released from its initial position, for example.

A downhole end 165 of the traveling sleeve 128 (also see FIG. 5), which may include a seat stop sleeve 130, may be aligned, axially guided and/or supported by an annular piston or lowlock sleeve 117. The lowlock sleeve 117 may be axially coupled to a push sleeve 115 that may be cylindrically retained between the traveling sleeve 128 and the inner bore 151 of the tubular body 108. When the traveling sleeve 128 is in the "ready" or initial position during drilling, the hydraulic pressure may act on the push sleeve 115, such as concentric to the tool axis and upon the lowlock sleeve 117 between the outer bore 162 of the traveling sleeve 128 and the inner bore 151 of the tubular body 108, for example. With or without hydraulic pressure when the expandable reamer apparatus 100 is in the initial position, the push sleeve 115 may be prevented from moving in the uphole direction 159 by a lowlock assembly, such as, for example, one or more dogs 166 of lowlock sleeve 117.

The dogs 166 may be positionally retained between an annular groove 167 in the inner bore 151 of the tubular body 108 and the seat stop sleeve 130. Each dog 166 of the lowlock sleeve 117 is a collet or locking dog latch having an expandable detent 168 that may engage the groove 167 of the tubular body 108 when compressively engaged by the seat stop sleeve 130. The dogs 166 hold the lowlock sleeve 117 in place and may prevent the push sleeve 115 from moving in the uphole direction 159 until the "end" or seat stop sleeve 130, with its larger outer diameter 169, travels beyond the lowlock sleeve 117, which may allow the dogs 166 to retract axially inward toward the smaller outer diameter 170 of the traveling sleeve 128. When the dogs 166 retract axially inward, for example, they may be disengaged from the groove 167 of the tubular body 108, which may allow the push sleeve 115 to be subjected to hydraulic pressure primarily in the axial direction, such as in the uphole direction 159.

The shear assembly 150 may require an affirmative act, such as introducing a ball or other restriction element into the expandable reamer apparatus 100, to cause the pressure from hydraulic fluid flow to increase, before the shear screws 127 will shear. The downhole end 165 of the traveling sleeve 128 may include within its inner bore a ball trap sleeve 129 that may include a plug 131. An O-ring seal 139 may also provide a seal between the ball trap sleeve 129 and the plug 131. A restriction element in the form of ball 147, for example, may be introduced into the expandable reamer apparatus 100 in order to enable operation of the expandable reamer apparatus 100 to initiate or "trigger" the action of the shear assembly 150. After the ball 147 is introduced, fluid will carry ball 147 into the ball trap sleeve 129, which may allow ball 147 to be retained and sealed by the seat part of plug 131 and the ball trap sleeve 129. If or when the ball 147 occludes fluid flow by being trapped in the ball trap sleeve 129, the fluid or hydraulic pressure may build up within the expandable reamer apparatus 100 until, for example, the shear screws 127 shear. After the shear screws 127 shear, the traveling sleeve 128 along with the coaxially retained seat stop sleeve 130 may axially travel, under the influence of the hydraulic pressure, for example, in the downhole direction 157 until the traveling sleeve 128 is again axially retained by the uplock sleeve 124, which, as described above, moves into a lower position. Thereafter, for example, the fluid flow may be re-established through the fluid ports 173 in the traveling sleeve 128 above the ball 147.

Optionally, the ball 147 used to activate the expandable reamer apparatus 100 may engage the ball trap sleeve 129 and the plug 131 that include malleable characteristics, such that the ball 147 may swage therein as it seats. This may prevent the ball 147 from moving around and potentially causing problems or damage to the expandable reamer apparatus 100.

Figure 5:
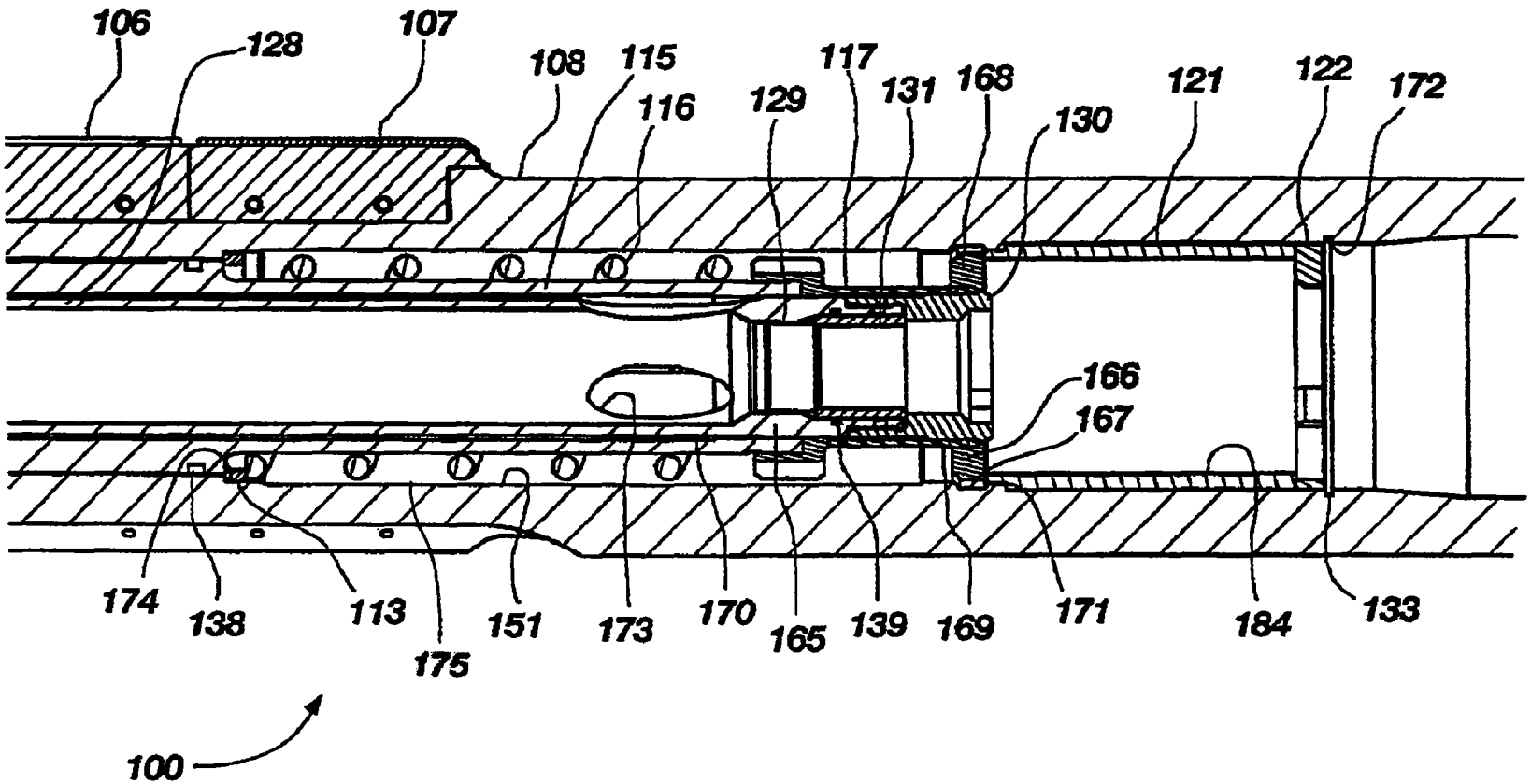
FIG. 5 illustrates an enlarged cross-sectional view of another portion of the expandable reamer apparatus shown in FIG. 3 utilizing certain aspects of the present inventions.
Figure 22:
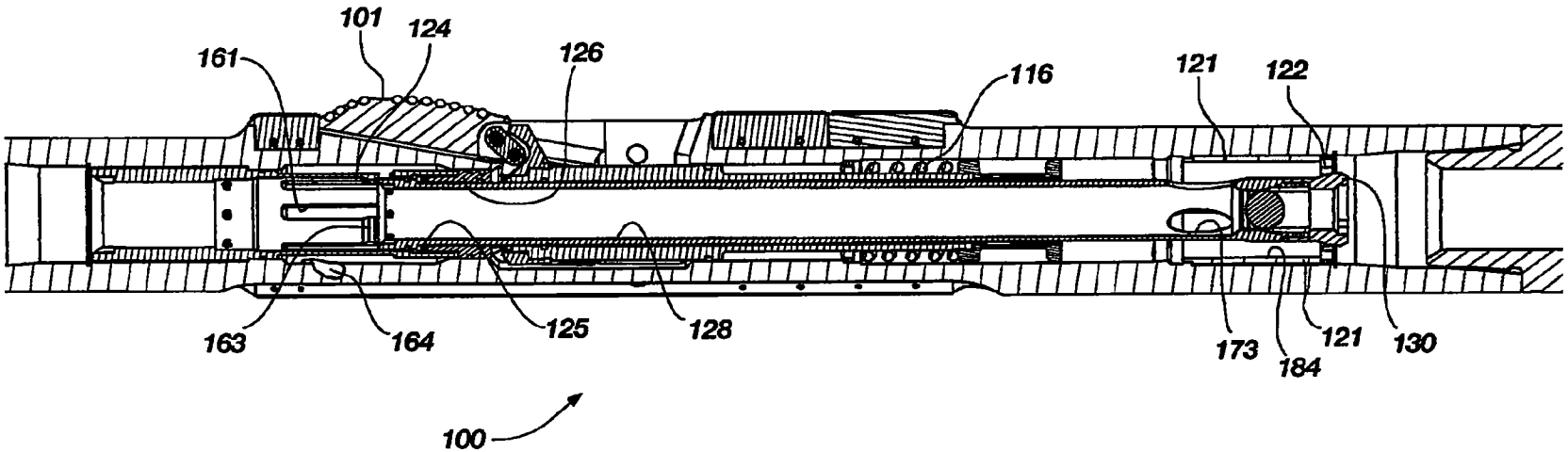
FIG. 22 illustrates a partial, longitudinal cross-sectional illustration of the expandable reamer apparatus of FIG. 17 in which the blades (one depicted) are held in the fully extended position by the push sleeve under the influence of fluid pressure and the traveling sleeve moves into the retained position and utilizing certain aspects of the present inventions.

Also, in order to support the traveling sleeve 128 and mitigate vibration effects after the traveling sleeve 128 is axially retained, for example, the seat stop sleeve 130 and the downhole end 165 of the traveling sleeve 128 may be retained in a stabilizer sleeve 122. Reference may also be made to FIGS. 5 and 22. The stabilizer sleeve 122 may be coupled to the inner bore 151 of the tubular body 108 and retained between a retaining ring 133 and a protect sleeve 121, which may be held by an annular lip 171 in the inner bore 151 of the tubular body 108. The retaining ring 133 may be held within an annular groove 172 in the inner bore 151 of the tubular body 108. The protect sleeve 121 may provide protection from the erosive nature of the hydraulic fluid to the tubular body 108, for example, by allowing hydraulic fluid to flow through fluid ports 173 of the traveling sleeve 128, impinge upon the protect sleeve 121 and past the stabilizer sleeve 122 when the traveling sleeve 128 is retained therein.

Figure 21:
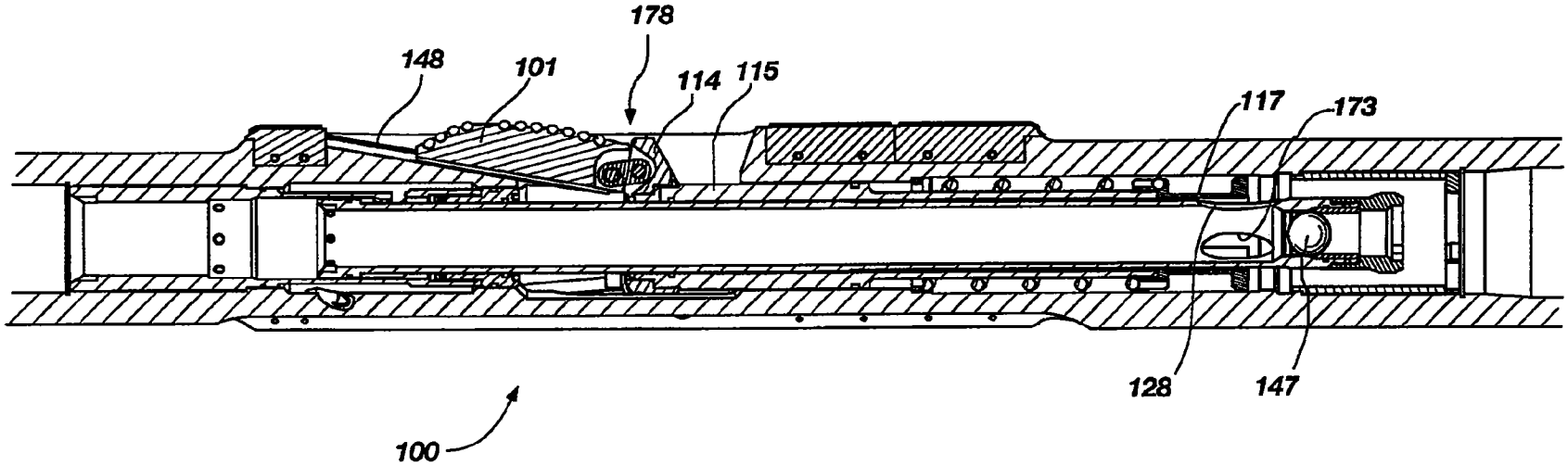
FIG. 21 illustrates a partial, longitudinal cross-sectional illustration of the expandable reamer apparatus of FIG. 17 in which the traveling sleeve moves toward a lower, retained position while a blade being urged by a push sleeve under the influence of fluid pressure moves toward an extended position and utilizing certain aspects of the present inventions.

After the traveling sleeve 128 travels sufficiently far enough to allow the dogs 166 of the lowlock sleeve 117 to be disengaged from the groove 167 of the tubular body 108, for example, the dogs 166 of the lowlock sleeve 117, which may be connected to the push sleeve 115, may all move in the uphole direction 159. Reference may also be made to FIGS. 5, 6 and 21. In order for the push sleeve 115 to move in the uphole direction 159, the differential pressure between the inner bore 151 and the outer side 183 of the tubular body 108 caused by the hydraulic fluid flow must be sufficient to overcome the restoring force or bias of a spring 116, which may be any force or bias required by a particular application. The compression spring 116 that may resist the motion of the push sleeve 115 in the uphole direction 159 may be retained on the outer surface 175 of the push sleeve 115, for example, between a ring 113 attached in a groove 174 of the tubular body 108 and the lowlock sleeve 117. The push sleeve 115 may axially travel in the uphole direction 159 under the influence of the hydraulic fluid, but may be restrained from moving beyond the top lip of the ring 113 and beyond the protect sleeve 184 in the downhole direction 157. The push sleeve 115 may include a seal, such as T-seal 138, between the tubular body 108, a seal, such as T-seal 137, between the traveling sleeve 128, and a seal, such as wiper seal 141, between the traveling sleeve 128 and push sleeve 115.

Figure 16:
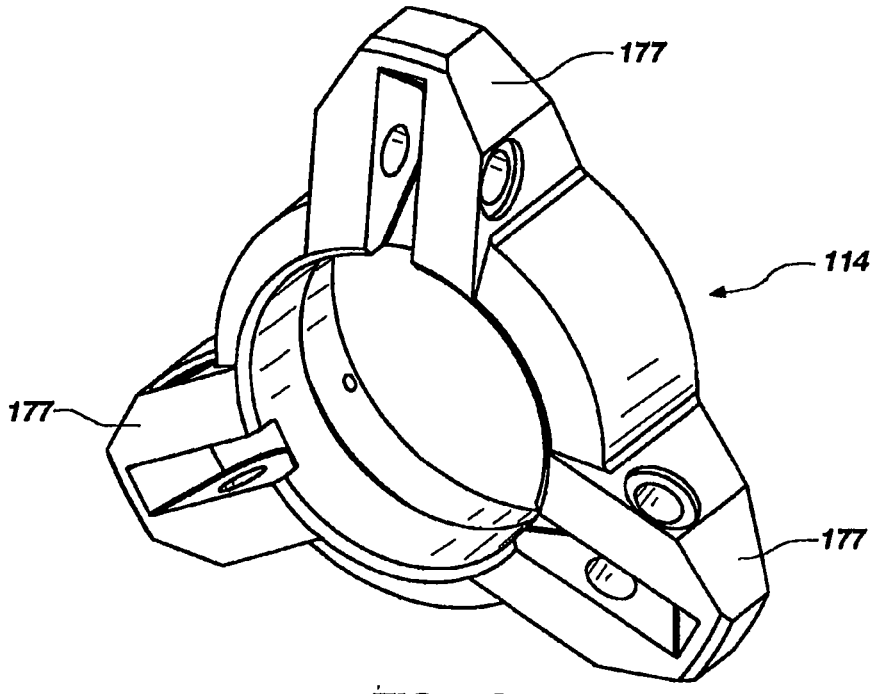
FIG. 16 illustrates a perspective view of a yoke of one of many embodiments of an expandable reamer apparatus utilizing certain aspects of the present inventions.

The push sleeve 115 may include at its uphole section 176 a yoke 114 coupled thereto as shown in FIG. 6, for example. The yoke 114 (also shown in FIG. 16) may include three arms 177, each of which may be coupled to one of the blades 101, 102, 103, for example by a pinned linkage 178. Each arm 177 may include a shaped surface suitable for expelling debris, for example, as the blades 101, 102, 103 are retracted toward the retracted position. The shaped surface of the arms 177, in conjunction with the adjacent wall of the cavity of the body 108, may provide included angles of approximately 20 degrees, which may be preferable for dislodging or removing any packed-in shale, and may further include low-friction surface material, such as to prevent sticking by formation cuttings or other debris. The pinned linkage 178 may include a linkage 118 coupling a blade to the arm 177, where the linkage 118 may be coupled to the blade by a pin, such as blade pin 119, and secured by a retaining ring 142, and the linkage 118 may be coupled to the arm 177 by a yoke pin 120, which is secured by a cotter pin 144, for example. The pinned linkage 178 may allow the blades 101, 102, 103 to rotationally transition about the arms 177 of the yoke 114, particularly as the actuating means directly transitions the blades 101, 102, 103 between the extended and retracted positions. Advantageously, the actuating means, i.e., the push sleeve 115, the yoke 114, and/or the linkage 178, may directly retract as well as extend the blades 101, 102, 103, whereas conventional wisdom has directed the use of one part for harnessing hydraulic pressure to force the blade laterally outward and another part, such as a spring, to force the blades inward.

In order that the blades 101, 102, 103 may transition between the extended and retracted positions, they may each be positionally coupled to one of the blade tracks 148 in the tubular body 108, as particularly shown in FIGS. 3 and 6. The blade 101 may also be shown in FIGS. 10-14. The blade track 148 may include a dovetail shaped groove 179 that may axially extend along the tubular body 108, such as on a slanted slope 180 having an acute angle with respect to the longitudinal axis $L_8$. Each of the blades 101, 102, 103 may include a dovetail shaped rail 181 that substantially matches the dovetail shaped groove 179 of the blade track 148 in order to slideably secure the blades 101, 102, 103 to the tubular body 108. When the push sleeve 115 is influenced by the hydraulic pressure, for example, the blades 101, 102, 103 may be extended upward and outward through a blade passage port 182 into the extended position, such as ready for reaming the formation or wellbore wall. The blades 101, 102, 103 may be pushed along the blade tracks 148 until, for example, the forward motion is stopped, such as by the tubular body 108 or the upper stabilizer block 105 being coupled to the tubular body 108. In the upward-outward or fully extended position, the blades 101, 102, 103 may, but need not, be positioned such that the cutting elements 104 will enlarge a bore hole in the subterranean formation by a prescribed amount, which may be any amount, including none. When hydraulic pressure provided by, for example, drilling fluid flow through expandable reamer apparatus 100 is released, the spring 116 may urge the blades 101, 102, 103 via the push sleeve 115 and the pinned linkage 178 into the retracted position. Should the assembly not readily retract via spring force, when the tool is pulled up the borehole to a casing shoe, for example, the shoe may contact the blades 101, 102, 103, which may help to urge or force them down the tracks 148, such as to allow the expandable reamer apparatus 100 to be retrieved from the borehole. In this respect, the expandable reamer apparatus 100 may include a retraction assurance feature to further assist in removing the expandable reamer apparatus from a borehole. The slope 180 of blade tracks 148 may be any value, but is shown in this exemplary embodiment of the invention to be about ten degrees, taken with respect to the longitudinal axis $L_8$ of the expandable reamer apparatus 100. While the slope 180 of the blade tracks 148 is shown to be about ten degrees, it may vary from a greater extent to a lesser extent than that illustrated. However, the slope 180 should be less than substantially 35 degrees, for reasons discussed below, to obtain the full benefit of this aspect of the invention. The blades 101, 102, 103, being "locked" into the blade tracks 148 with the dovetail shaped rails 181 as they are axially driven into the extended position may permit looser tolerances as compared to conventional hydraulic reamers, which may require close tolerances between the blade pistons and the tubular body to radially drive the blade pistons into their extended position. Accordingly, the blades 101, 102, 103 may be more robust and less likely to bind or fail due to blockage from the fluid. In this exemplary embodiment of the invention, the blades 101, 102, 103 may have ample clearance in the grooves 179 of the blade tracks 148, such as a 1/16 inch clearance, more or less, between the dovetail-shaped rail 181 and dovetail-shaped groove 179. It is to be recognized that the term "dovetail" when making reference to the groove 179 or the rail 181 is not to be limiting, but is directed broadly toward structures in which each blade 101, 102, 103 may be retained with the body 108 of the expandable reamer apparatus 100, while further allowing the blades 101, 102, 103 to transition between two or more positions along the blade tracks 148 without binding or mechanical locking.

Advantageously, the natural, reactive forces that may act on the cutters 104 on the blades 101, 102, 103 during rotation of expandable reamer apparatus 100 in engaging a formation while reaming a borehole may help to further push the blades 101, 102, 103 in the extended outward direction, holding them with this force in their fully outward or extended position. Drilling forces acting on the cutters 104, therefore, along with higher pressure within expandable reamer apparatus 100 creating a pressure differential with that of the borehole exterior to the tool, may help to further hold the blades 101, 102, 103 in the extended or outward position. Also, as the expandable reamer apparatus 100 is reaming or drilling, the fluid pressure may be reduced when the combination of the slope 180 of the blade tracks 148 is, for example, sufficiently shallow allowing the reactive forces acting on the cutters 104 or blades 101, 102, 103 to offset the biasing effect of the biasing spring 116. In this regard, application of hydraulic fluid pressure may be substantially minimized while drilling, as a mechanical advantage may allow the reactive forces acting on the cutters 104 when coupled with the substantially shallower slanted slope 180 of the tracks 148 to provide the requisite reaction force for retaining the blades 101, 102, 103 in their extended positions. Conventional reamers, which may have blades extending substantially laterally outward from an extent of 35 degrees or greater (referenced to the longitudinal axis), may require the full, and continued, application of hydraulic pressure to maintain the blades in an extended position. Accordingly and unlike the case with conventional expandable reamers, the blades 101, 102, 103 of expandable reamer apparatus 100 may have a tendency to open as opposed to tending to close when reaming a borehole. The direction of the net cutting force and, thus, of the reactive force may be adjusted by altering the backrake, exposure and siderake of the cutters 104, for example, which may or may not be present, to better achieve a net force tending to move the blades 101, 102, 103 to their fullest outward extent. A similar effect may also be accomplished without the use of cutters 104, such as, for example, in other embodiments described herein.

Another advantage of a so-called "shallow track," i.e., the substantially small slope 180 having an acute angle, may be, for example, greater spring force retraction efficiency. Improved retraction efficiency enables improved or customized spring rates to be utilized to control the extent of the biasing force by the spring 116, such as selecting the biasing force required to be overcome by hydraulic pressure to begin to move or fully extend the blades 101, 102, 103. Also, with improved retraction efficiency, greater assurance of blade retraction may be had, for example, when the hydraulic fluid pressure is removed from the expandable reamer apparatus 100. Optionally, the spring may be preloaded when the expandable reamer apparatus 100 is in the initial or retracted position, which may allow a minimal amount of retraction force to be constantly applied.

Another advantage provided by the blade tracks 148 may be the unitary design of each "dovetail shaped" groove 179, there being one groove 179 for receiving one of the oppositely opposed "dovetail shaped" rails 181 of the guides 187 on each side of the blades 101, 102, 103. In conventional expandable reamers, each side of a movable blade may include a plurality of ribs or channels for being received into opposing channels or ribs of the reamer body, respectively, wherein such arrangements may be highly prone to binding when, for example, the blades are subjected to operational forces and pressures. In addition to ease of blade extension and retraction without binding along or in the track 148, the single rail and cooperating groove design may provide non-binding structural support for blade operation, particularly when engaging a formation while reaming, for example.

In addition to the upper stabilizer block 105, the expandable reamer apparatus 100 may include a mid stabilizer block 106 and a lower stabilizer block 107. Optionally, the mid stabilizer block 106 and the lower stabilizer block 107 may be combined into a unitary stabilizer block. The stabilizer blocks 105, 106, 107 help to center the expandable reamer apparatus 100 in the drill hole while being run into position through a casing or liner string or, as another example, while drilling and reaming the borehole. As mentioned above, the upper stabilizer block 105 may be used to stop or limit the forward motion of the blades 101, 102, 103, which may determine the extent to which the blades 101, 102, 103 may engage a bore hole while drilling. The upper stabilizer block 105, in addition to providing a back stop for limiting the lateral extent of the blades, may provide for additional stability when, for example, the blades 101, 102, 103 are retracted and the expandable reamer apparatus 100 of a drill string is positioned within a bore hole in an area where an expanded hole is not desired while the drill string is rotating.

Advantageously, the upper stabilizer block 105 may be mounted, removed and/or replaced by a technician, particularly in the field, which may allow the extent to which the blades 101, 102, 103 engage the bore hole to be readily increased or decreased to a different extent than illustrated. Optionally, it is recognized that a stop associated on a track side of the block 105 may be customized in order to arrest the extent to which the blades 101, 102, 103 may laterally extend when fully positioned to the extended position along the blade tracks 148. The stabilizer blocks 105, 106, 107 may include hard faced bearing pads (not shown), for example, to provide a surface for contacting a wall of a bore hole while stabilizing the apparatus therein during a drilling operation.

Figure 9:
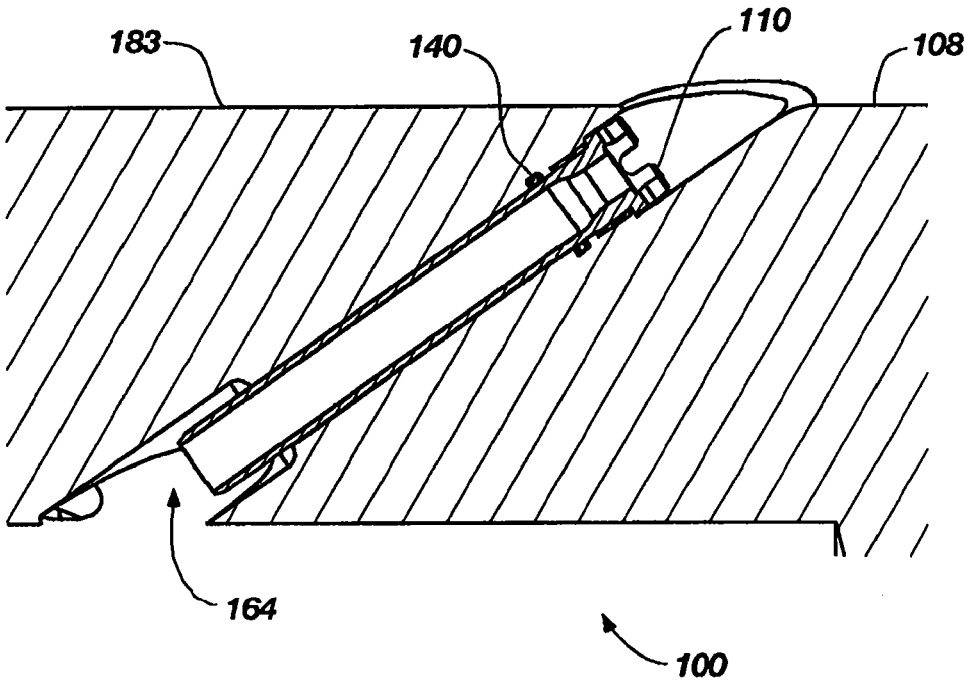
FIG. 9 illustrates a cross-sectional view of a nozzle assembly of one of many embodiments of an expandable reamer apparatus utilizing certain aspects of the present inventions.
Figure 10:
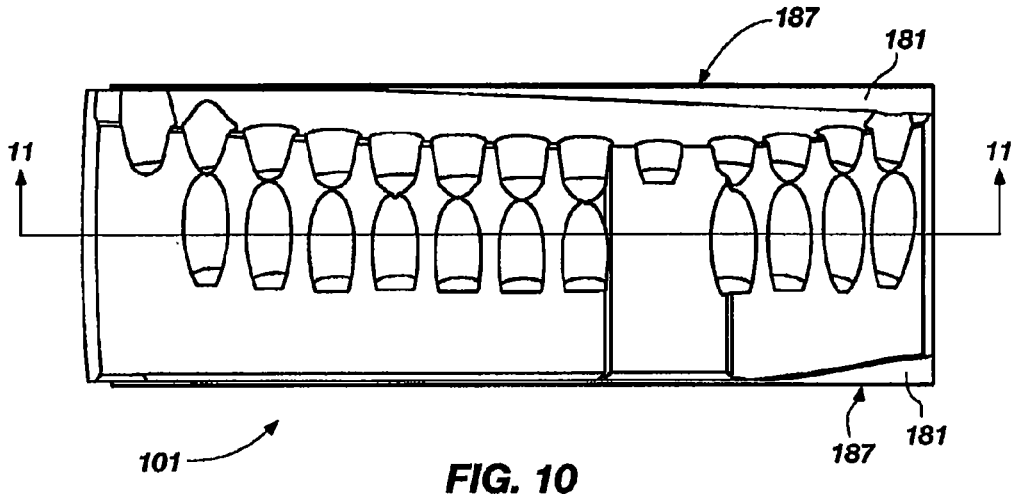
FIG. 10 illustrates a top view of a blade in accordance with one of many embodiments of the reamer utilizing certain aspects of the present inventions.
Figure 11:
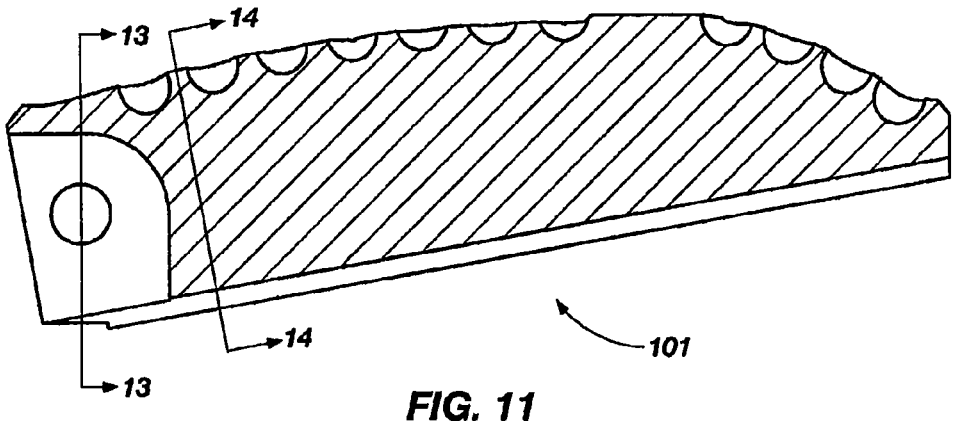
FIG. 11 illustrates a longitudinal cross-sectional view of the blade taken along section line 11-11 in FIG. 10 utilizing certain aspects of the present inventions.
Figure 12:
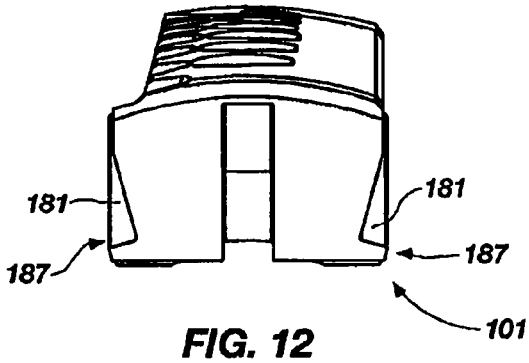
FIG. 12 illustrates a longitudinal end view of the blade of FIG. 10 utilizing certain aspects of the present inventions.
Figure 13:
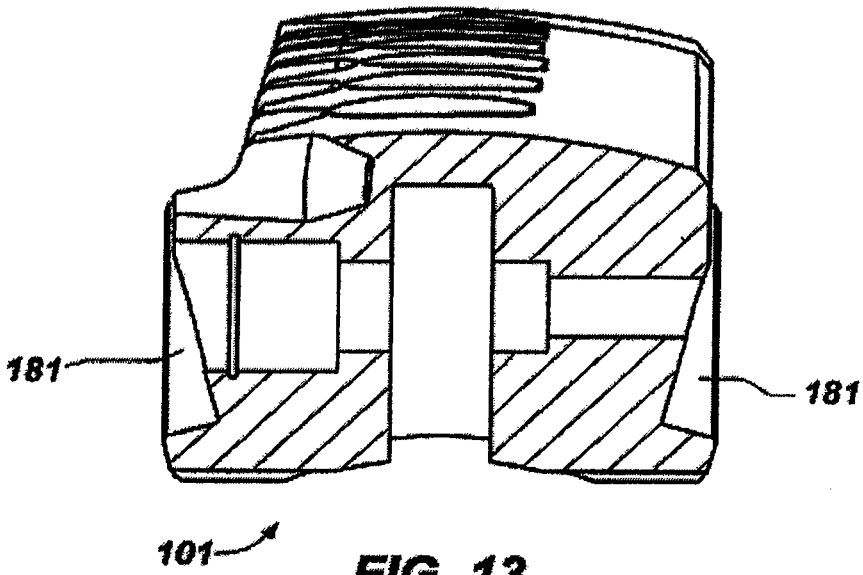
FIG. 13 illustrates a cross-sectional view taken along section line 13-13 in FIG. 11 utilizing certain aspects of the present inventions.
Figure 14:
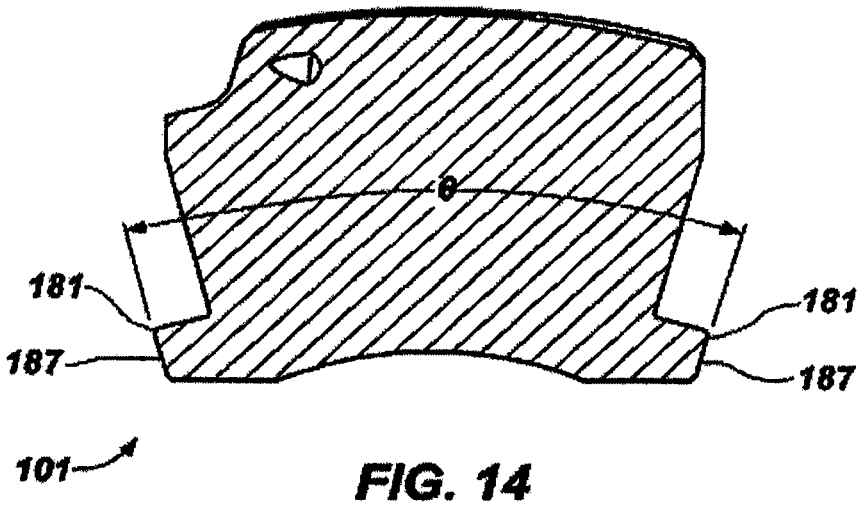
FIG. 14 illustrates a cross-sectional view taken along section line 14-14 in FIG. 11 utilizing certain aspects of the present inventions.
Figure 15:
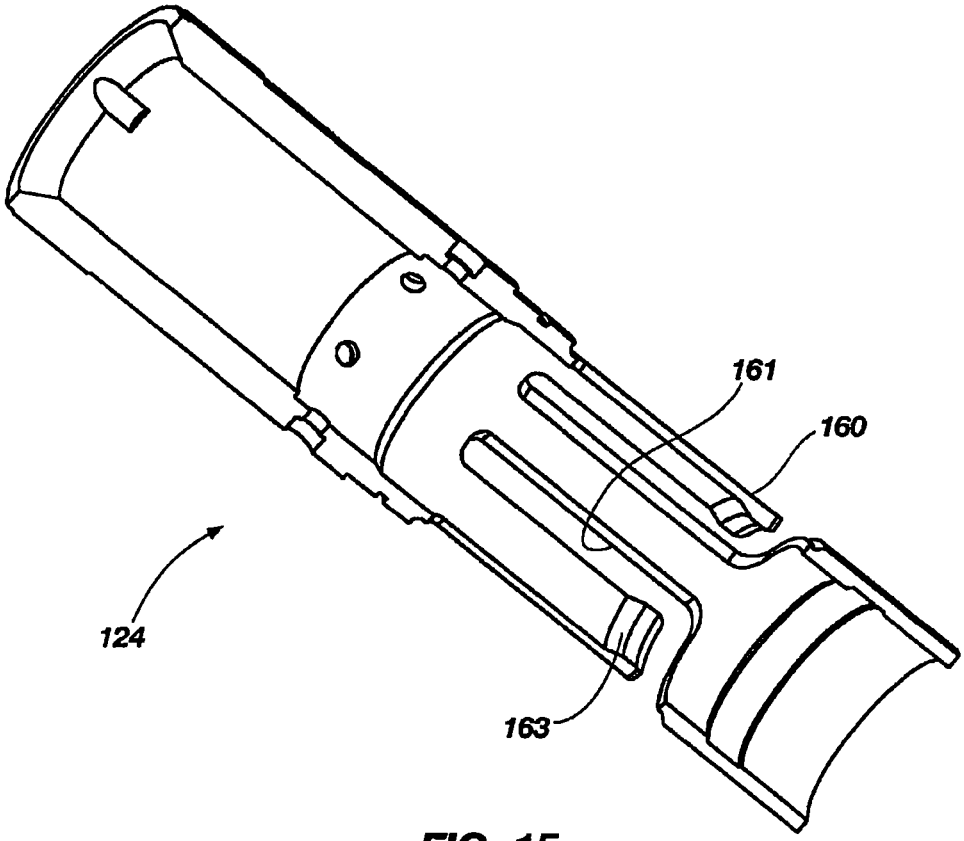
FIG. 15 illustrates a cross-sectional view of an uplock sleeve of one of many embodiments of an expandable reamer apparatus utilizing certain aspects of the present inventions.

Also, the expandable reamer apparatus 100 may include tungsten carbide nozzles 110 as shown in FIG. 9. The nozzles 110 are provided to cool and clean the cutting elements 104, for example, or to clear debris from blades 101, 102, 103 during drilling. The nozzles 110 may include a seal, such as O-ring seal 140, between each nozzle 110 and the tubular body 108 to provide a seal between the two components. As shown, the nozzles 110 are configured to direct drilling fluid towards the blades 101, 102, 103 in the down-hole direction 157, but may be configured to direct fluid laterally, in the uphole direction 159, or in any direction required by a particular application.

Figure 18:
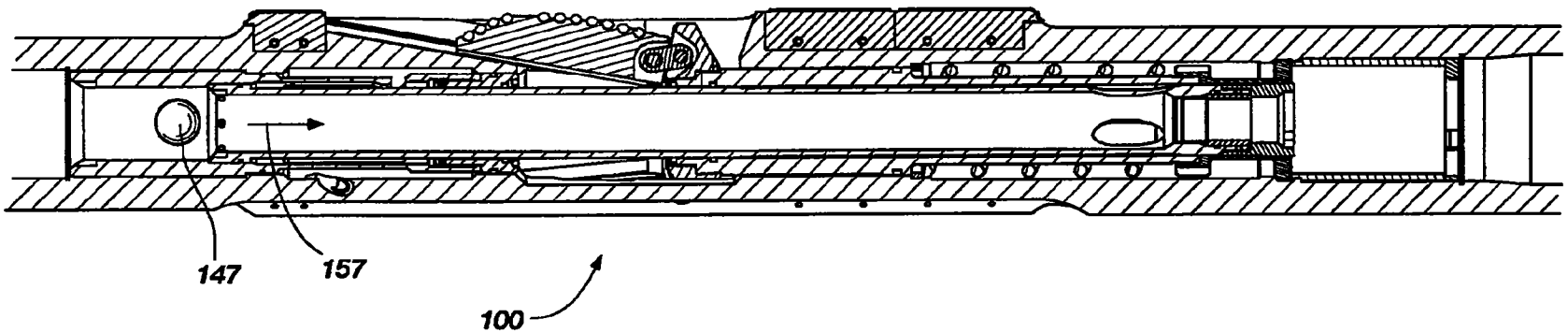
FIG. 18 illustrates a partial, longitudinal cross-sectional illustration of the expandable reamer apparatus of FIG. 17 in the initial tool position, receiving a ball in a fluid path and utilizing certain aspects of the present inventions.
Figure 19:
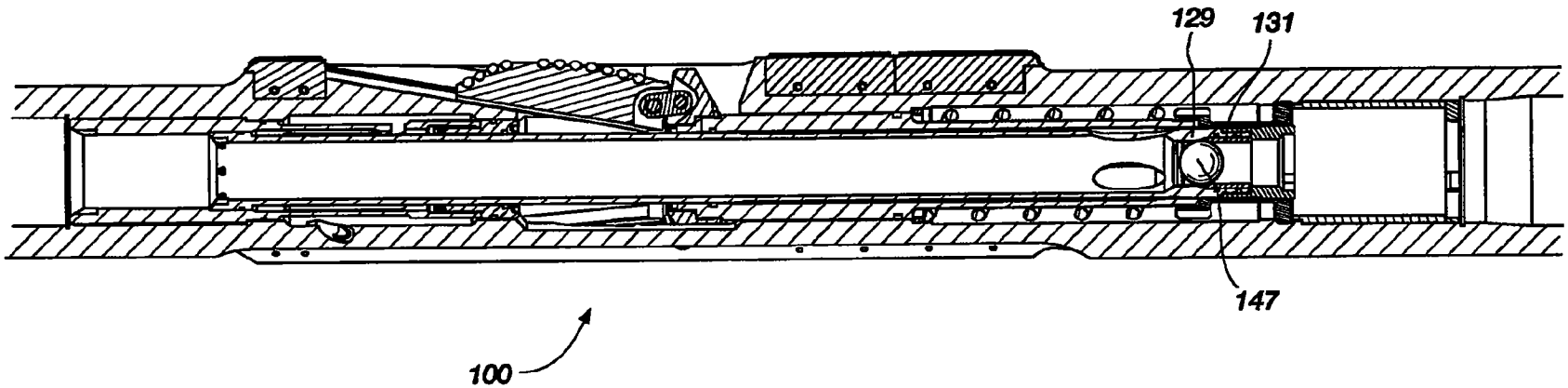
FIG. 19 illustrates a partial, longitudinal cross-sectional illustration of the expandable reamer apparatus of FIG. 17 in the initial tool position in which the ball moves into a ball seat and is captured and utilizing certain aspects of the present inventions.

The expandable reaming apparatus, or reamer, 100 is now described in terms of its operational aspects. Reference may be made to FIGS. 17-23, in particular, and optionally to FIGS. 1-16, as desirable. The expandable reamer apparatus 100 may be installed in a bottomhole assembly above a pilot bit and, if included, above or below the measurement while drilling (MWD) device and incorporated into a rotary steerable system (RSS) and rotary closed loop system (RCLS), for example. Before "triggering" the expandable reamer apparatus 100, the expandable reamer apparatus 100 may be maintained in an initial, retracted position as shown in FIG. 17. For example, the traveling sleeve 128 within the expandable reamer apparatus 100 may isolate the fluid flow path and prevents inadvertent extension of blades 101, 102, 103, as previously described, and may be retained by the shear assembly 150, such as with shear screws 127 secured to the uplock sleeve 124, which may be attached to the tubular body 108. While the traveling sleeve 128 is held in the initial position, the blade actuating means may be prevented from directly actuating the blades 101, 102, 103, whether acted upon by biasing forces or hydraulic forces. The traveling sleeve 128 may have, on its lower end, an enlarged end piece, such as seat stop sleeve 130. This larger diameter seat stop sleeve 130 may hold the dogs 166 of the lowlock sleeve 117 in a secured position, which may prevent the push sleeve 115 from moving upward under effects of differential pressure and activating the blades 101, 102, 103. The latch dogs 166 may lock the latch or expandable detent 168 into a groove 167 in the inner bore 151 of the tubular body 108. When it is desired to trigger the expandable reamer apparatus 100, drilling fluid flow may be momentarily ceased, if required, and a ball 147, or other fluid restricting element, may be dropped into the drill string and pumping of drilling fluid resumed. The ball 147 may move in the down-hole direction 157 under the influence of gravity and/or the flow of the drilling fluid, as shown in FIG. 18. After a short time, for example, the ball 147 may reach a ball seat of the ball trap sleeve 129, as shown in FIG. 19. The ball 147 may stop drilling fluid flow, which may cause pressure to build above it in the drill string. As the pressure builds, the ball may be further seated into or against the plug 131, which may be made of, or lined with, a resilient material such as tetrafluoroethylene (TFE).

Figure 20:
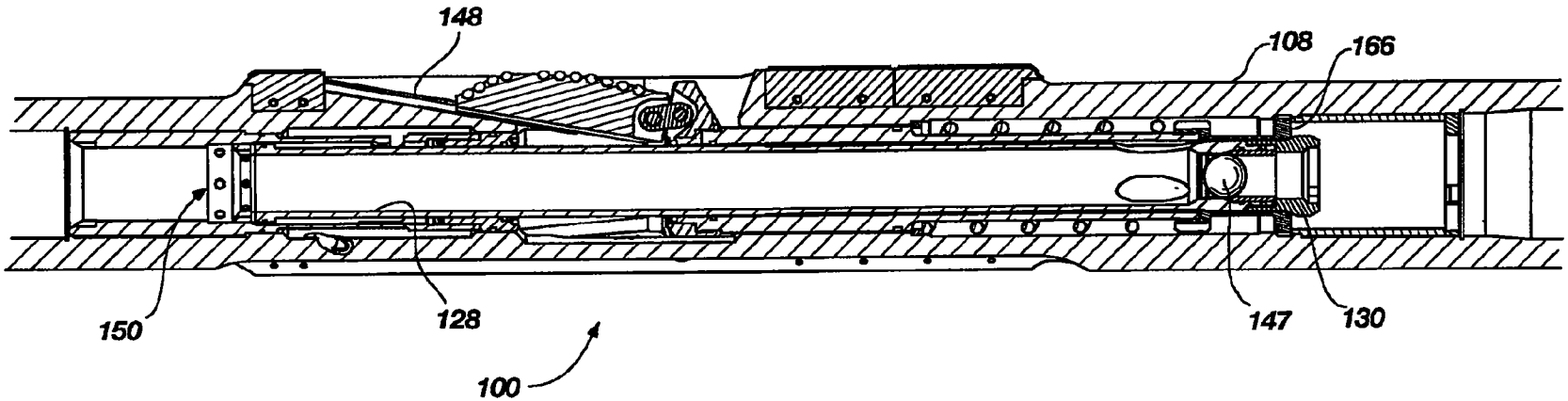
FIG. 20 illustrates a partial, longitudinal cross-sectional illustration of the expandable reamer apparatus of FIG. 17 in which a shear assembly is triggered as pressure is accumulated and a traveling sleeve begins to move down within the apparatus, leaving the initial tool position and utilizing certain aspects of the present inventions.

Referring to FIG. 20, at a predetermined pressure level, which may be set based on, for example, the number and individual shear strengths of the shear screws 127 (made of brass or other suitable material) installed initially in the expandable reamer apparatus 100, the shear screws 127 may fail in the shear assembly 150, which may allow the traveling sleeve 128 to unseal and move downward. As the traveling sleeve 128 with the larger end of the seat stop sleeve 130 moves downward, the latch dogs 166 of the lowlock sleeve 117 may be free to move inward toward the smaller diameter of the traveling sleeve 128 and become free of the body 108.

Thereafter, as illustrated in FIG. 21, the lowlock sleeve 117 may be attached to the pressure-activated push sleeve 115 which may now move upward under fluid pressure influence as fluid is allowed to pass through the fluid ports 173 exposed as the traveling sleeve 128 moves downward. As the fluid pressure is increased, the biasing force of the spring may be overcome, which may allow the push sleeve 115 to move in the uphole direction 159. The push sleeve 115 may be attached to the yoke 114 which may be attached by pins and linkage assembly 178 to the three blades 101, 102, 103, which may now be moved upwardly by the push sleeve 115. In moving upward, the blades 101, 102, 103 each may follow a ramp or track 148 to which they are mounted, via a type of modified square dovetail groove 179 (shown in FIG. 2), for example.

With reference to FIG. 22, the stroke of the blades 101, 102, 103 may be stopped in the fully extended position by upper hard faced pads on the stabilizer block 105, for example. Optionally, as mentioned herein above, a customized stabilizer block may be assembled to the expandable reamer apparatus 100 prior to drilling in order to adjust and limit the extent to which the blades 101, 102, 103 may extend. With the blades 101, 102, 103 in the extended position, reaming a borehole may commence.

As reaming takes place with the expandable reamer apparatus 100, the lower and mid hard face pads 106, 107 may help to stabilize the tubular body 108, for example, as the cutters 104 of the blades 101, 102, 103 ream a larger borehole and the upper hard face pads 105 also may help to stabilize the top of the expandable reamer 100 when the blades 101, 102 and 103 are in the retracted position.

After the traveling sleeve 128 with the ball 147 moves downward, it may come to a stop with the flow bypass or fluid ports 173 located above the ball 147 in the traveling sleeve 128 exiting against the inside wall 184 of the hard faced protect sleeve 121, which may help prevent or minimize erosion damage from drilling fluid flow impinging thereupon. The drilling fluid flow may then continue down the bottomhole assembly, and the upper end of the traveling sleeve 128 may become "trapped," i.e., locked, between the ears 163 of the uplock sleeve 124 and the shock absorbing member 125 of the seal sleeve 126 and the lower end of the traveling sleeve 128 may be laterally stabilized by the stabilizer sleeve 122.

Figure 23:
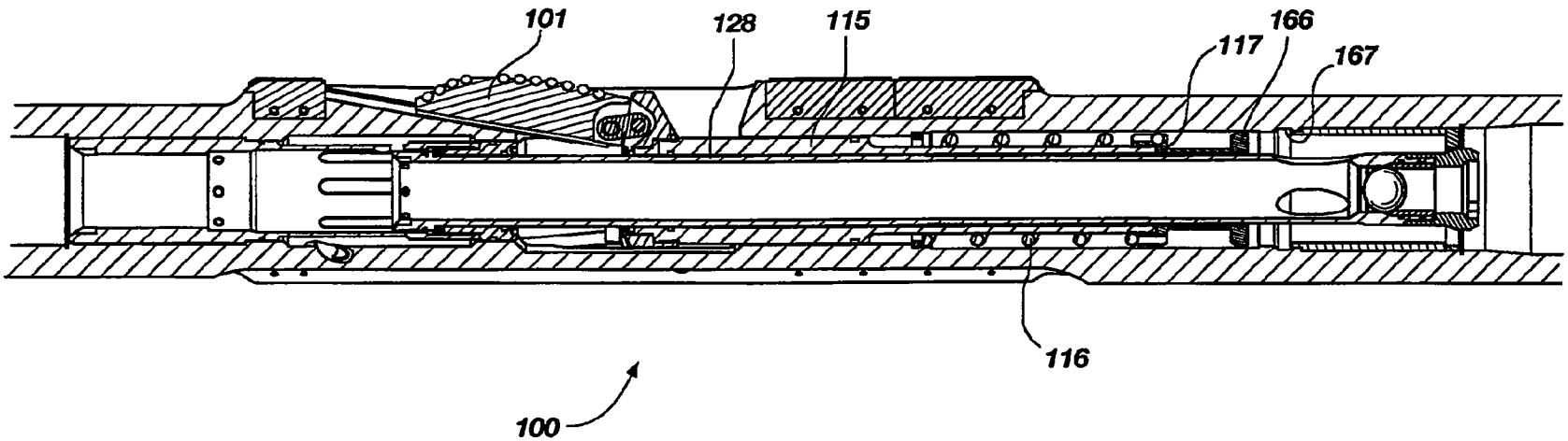
FIG. 23 illustrates a partial, longitudinal cross-sectional illustration of the expandable reamer apparatus of FIG. 17 in which the blades (one depicted) are retracted into a retracted position by a biasing spring when the fluid pressure is dissipated and utilizing certain aspects of the present inventions.

When drilling fluid pressure is released, the spring 116 may help drive the lowlock sleeve 117 and the push sleeve 115 with the attached blades 101, 102, 103 back downwardly and inwardly substantially to their original or initial position into the retracted position, see FIG. 23. However, since the traveling sleeve 128 has moved to a downward locked position, the larger diameter seat stop sleeve 130 may no longer hold the dogs 166 out and in the groove 167 and thus the latch or lowlock sleeve 117 stays unlatched and subjected to pressure differentials for subsequent operation or activation.

Whenever drilling fluid flow is reestablished in the drill pipe and through the expandable reamer apparatus 100, the push sleeve 115 with the yoke 114 and blades 101, 102, 103 may move upward with the blades 101, 102, 103 following the ramps or tracks 148 to again cut or ream the prescribed diameter in a borehole. Whenever drilling fluid flow is stopped, i.e. the differential pressure falls below the restoring force of the spring 116, the blades 101, 102, 103 may retract, such as described above, via the spring 116.

In aspects of the invention, the expandable reamer apparatus 100 may overcome disadvantages of conventional reamers. For example, one conventional hydraulic reamer may have utilized pressure from inside the tool to apply force against cutter pistons which moved radially outward. It is felt by some that the nature of the conventional reamer allowed misaligned forces to cock and jam the pistons, preventing the springs from retracting them. By providing the expandable reamer apparatus 100 that slides each of the blades up a relatively shallow-angled ramp, higher drilling forces may be used to open and extend the blades to their maximum position while transferring the forces through to the upper hard face pad stop with no damage thereto and subsequently allowing the spring to retract the blades thereafter without jamming or cocking.

The expandable reamer apparatus 100 may include blades that, if not retracted by the spring, may be pushed down the ramp of the track by contact with the borehole wall, for example, or the casing, which may allow the expandable reamer apparatus 100 to be pulled through the casing, providing a kind of failsafe function. The expandable reamer apparatus 100 may or may not be sealed around the blades, but does not require seals thereon, such as the expensive or custom-made seals used in some conventional expandable reamers.

The expandable reamer apparatus 100 may include clearances ranging from approximately 0.010 of an inch to 0.030 of an inch, for example between adjacent parts having dynamic seals therebetween. The dynamic seals may be all conventional, circular seals, or they may be custom seals, or any type of seal required by a particular application. Moreover, the sliding mechanism or actuating means, which may include the blades in the tracks, may include clearances ranging from about 0.050 of an inch to about 0.100 of an inch, particularly about the dovetail portions, for example. Clearances in the expandable reamer apparatus, the blades and the tracks may vary to a somewhat greater extent or a lesser extent than indicated herein. The larger clearances and tolerances of the parts of expandable reamer apparatus 100 may promote ease of operation, particularly with a reduced likelihood of binding caused by particulates in the drilling fluid and formation debris cut from the borehole wall, for example.

Additional aspects of the expandable reamer apparatus 100 are now provided:

The blade 101 may be held in place along the track 148 (shown in FIG. 2) by guides 187. The blade 101 may include mating guides 187 as shown in FIGS. 10-14, for example. Each guide 187 may be comprised of a single rail 108 oppositely located on each side of the block 101 and may include an included angle theta that may be selected to prevent binding with the mating guides of the track 148 or for another purpose required by a particular application. The included angle theta of the rails 181 of the blade 101 in this embodiment may be about 30 degrees, for example, such that the blade 101 may be prone to move away from or provide clearance about the track 148 in the body 108 when, for example, subjected to the hydraulic pressure.

The blades 101, 102, 103 may be attached to a yoke 114 with the linkage assembly, as described herein, which may allow the blades 101, 102, 103 to move upward and radially outward along the 10 degree ramp, in this embodiment of the invention, as the actuating means, i.e., the yoke 114 and push sleeve 115, moves axially upward. The link of the linkage assembly may, but need not, be pinned to both the blocks and the yoke in a similar fashion. The linkage assembly, in addition to allowing the actuating means to directly extend and retract the blades 101, 102, 103 substantially in the longitudinal or axial direction, may enable the upward and radially outward extension of the blades 101, 102, 103 by rotating through an angle, which may be any angle, approximately 48 degrees in this embodiment of the invention, during the direct actuation of the actuating means and the blades 101, 102, 103.

In case the blades 101, 102, 103 somehow do not readily move back down the ramp of the blade tracks 148 under biasing force from the retraction spring 116, then as the expandable reamer apparatus 100 is pulled from the bore hole, contact with the bore hole wall may bump the blades 101, 102, 103 down the slope 180 of the tracks 148. If needed, the blades 101, 102, 103 of the expandable reamer apparatus 100 may be pulled up against the casing, which may push the blades 101, 102, 103 further back into the retracted position, which may allow access and removal of the expandable reamer apparatus 100 through the casing. In other embodiments of the invention, the traveling sleeve may be sealed to prevent fluid flow from exiting the tool through the blade passage ports 182, and after triggering, the seal may be maintained.

The nozzles 110, as mentioned above, may be directed in the direction of flow through the expandable reamer apparatus 100 from within the tubular body 108 downward and outward radially to the annulus between tubular body 108 and a bore hole. Directing the nozzles 110 in such a downward direction may cause counterflow as the flow exits the nozzle and mixes with the annular moving counter flow returning up the borehole and may improve blade cleaning and cuttings removal. The nozzles 110 may be directed at the cutters of the blades 101, 102, 103 for maximum cleaning, and may be directionally optimized using computational fluid dynamics ("CFD") analysis.

Figure 4:
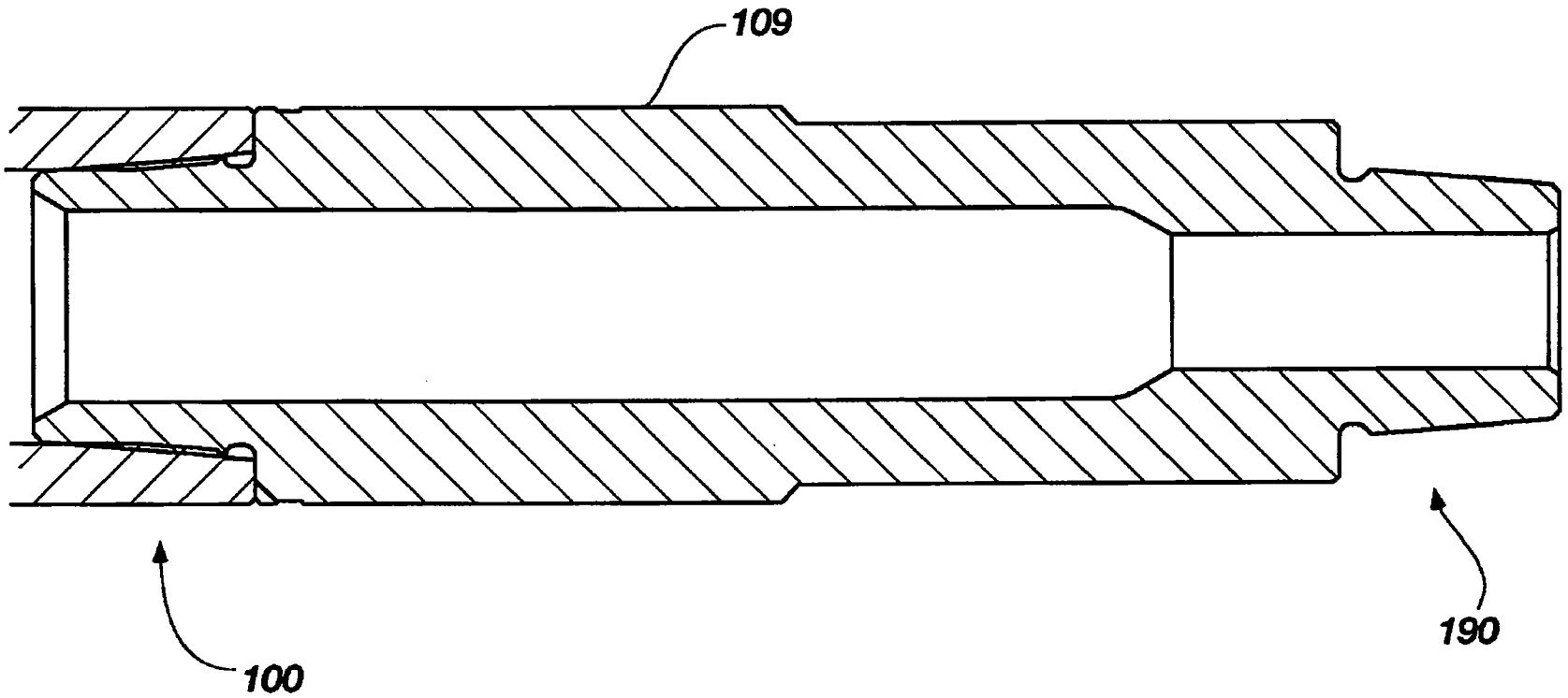
FIG. 4 illustrates an enlarged longitudinal cross-sectional view of a portion of the expandable reamer apparatus shown in FIG. 3 utilizing certain aspects of the present inventions.

The expandable reamer apparatus 100 may include a lower saver sub 109, such as the one shown in FIG. 4, that may connect to the lower box connection of the reamer body 108. Allowing the body 108 to be a single piece design, the saver sub 109 enables the connection between the two to be stronger (has higher makeup torque) than a conventional two piece tool having an upper and a lower connection. The saver sub 109, although not required, provides for more efficient connection to other downhole equipment or tools.

Still other aspects of the expandable reamer apparatus 100 are now provided:

The shear screws 127 of the shear assembly 150, retaining the traveling sleeve 128 and the uplock sleeve 124 in the initial position, may be used to provide or create a trigger, releasing when pressure builds to a predetermined value, which may be any value. The predetermined value at which the shear screws shear under drilling fluid pressure within expandable reamer apparatus 100 may preferably be 1000 psi, for example, or even 2000 psi. It is recognized that the pressure may range to a greater or lesser extent than presented herein to trigger the expandable reamer apparatus 100. Optionally, it is recognized that a great pressure at which the shear screws 127 shears may be provided to allow the spring element 116 to be conditionally configured and biased to a greater extent in order to further provide desired assurance of blade retraction upon release of hydraulic fluid.

Optionally, one or more of the blades 101, 102, 103 may be replaced with stabilizer blocks having guides and rails as described herein for being received into grooves 179 of the track 148 in the expandable reamer apparatus 100, which may be used as expandable concentric stabilizer rather than a reamer, which may further be utilized in a drill string with other concentric reamers or eccentric reamers. Alternatively, one or more of the blades 101, 102, 103 may include one or more roller elements, as will be further described below.

Optionally, the blades 101, 102, 103 may each include one row or three or more rows of cutting elements 104 rather than the two rows of cutting elements 104 shown in FIG. 2. Advantageously, two or more rows of cutting elements help to extend the life of the blades 101. 102, 103, particularly when drilling in hard formations. Blades 101, 102, 103 may include any of the above, singularly or in combination, as required by a particular application.

Figure 24:
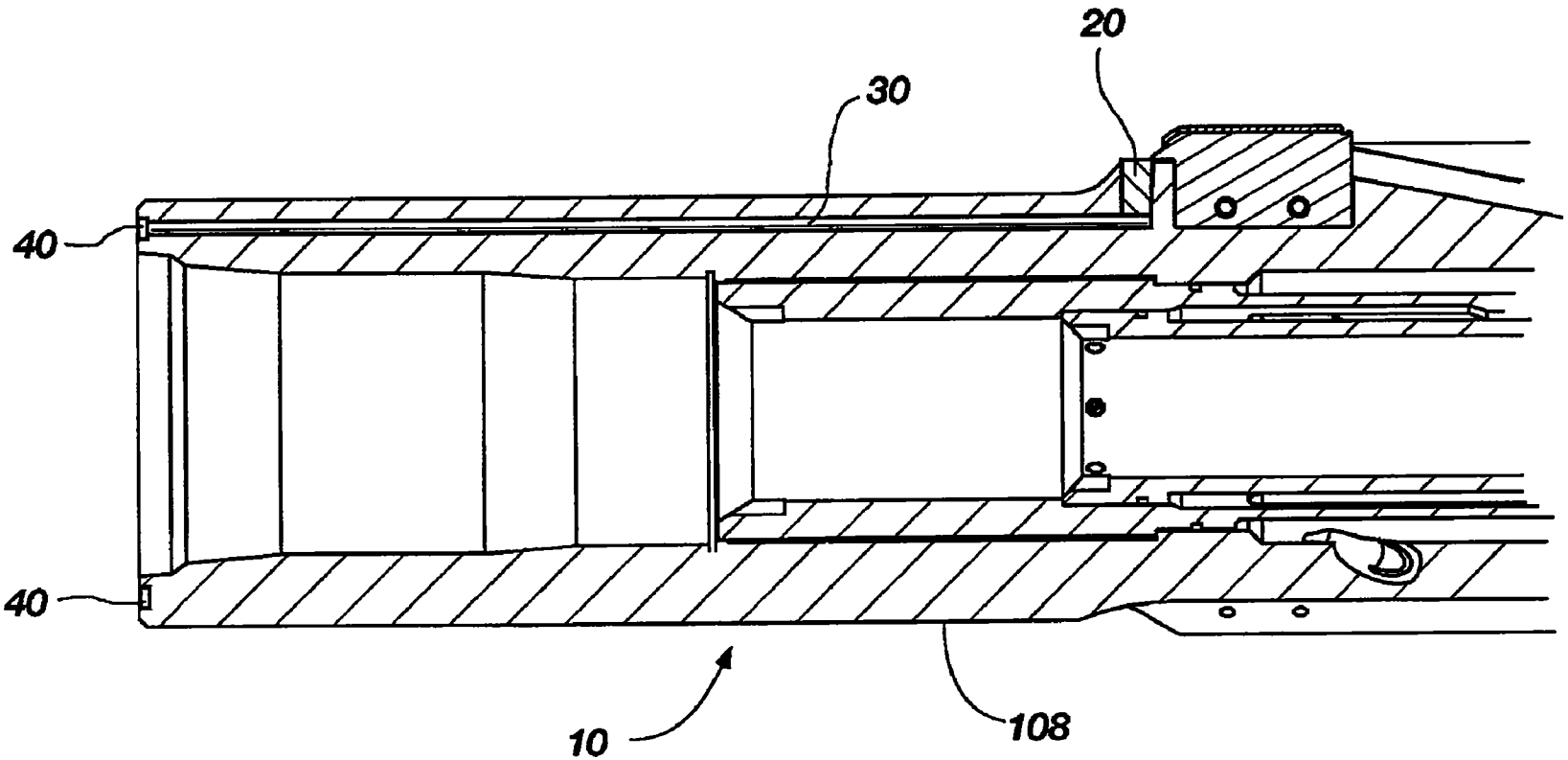
FIG. 24 illustrates a partial, longitudinal cross-sectional view of one of many embodiments of an expandable reamer apparatus including a borehole dimension measurement device and utilizing certain aspects of the present inventions.

FIG. 24 shows a cross-sectional view of an embodiment of an expandable reamer apparatus 10 having a measurement device 20 in accordance with another embodiment of the invention. The measurement device 20 may provide an indication of the distance between the expandable reamer apparatus 10 and a wall of a borehole being drilled, which may enable a determination to be made as to the extent at which the expandable reamer apparatus 10 may be enlarging a borehole. As shown, the measurement device 20 may be mounted to the tubular body 108 generally in a direction perpendicular to the longitudinal axis $L_8$ of the expandable reamer apparatus 10. The measurement device 20 may be coupled to a communication line 30 extending through a tubular body 108 of the expandable reamer apparatus 10 that may include an end connection 40 at the upper end 191 of the expandable reamer apparatus 10. The end connection 40 may be configured for connection compatibility with particular or specialized equipment, such as a MWD communication subassembly. The communication line 30 may also be used to supply power to the measurement device 20. The measurement device 20 may be configured for sensing, analyzing and/or determining the size of a bore hole, or it may be used purely for sensing in which the size of a bore hole may be analyzed or determined by other equipment as is understood by a person of skill in the MWD art, thereby providing a substantially accurate determination of a bore hole size. The measurement device 20 may become instrumental in determining when the expandable reamer apparatus 10 is not drilling at its intended diameter, allowing remedial measures to be taken rather than drilling for extended durations or thousands of feet to ream a borehole which then may have to be re-reamed.

The measurement device 20 may be part of a nuclear-based measurement system such as disclosed in U.S. Pat. No. 5,175,429 to Hall et al., the disclosure of which is fully incorporated herein by reference, and is assigned to the assignee of the invention herein disclosed. The measurement device 20 may also include sonic calipers, proximity sensors, or other sensors suitable for determining a distance between a wall of a borehole and the expandable reamer apparatus 10. Optionally, the measurement device 20 may be configured, mounted and used to determine the position of the movable blades and/or bearing pads of the expandable reamer apparatus 20, wherein the reamed minimum borehole diameter may be inferred from such measurements. Similarly, a measurement device may be positioned within the movable blade so as to be in contact with or proximate to the formation on the borehole wall, such as when the movable blade is actuated to its outermost fullest extent.

Figure 25:
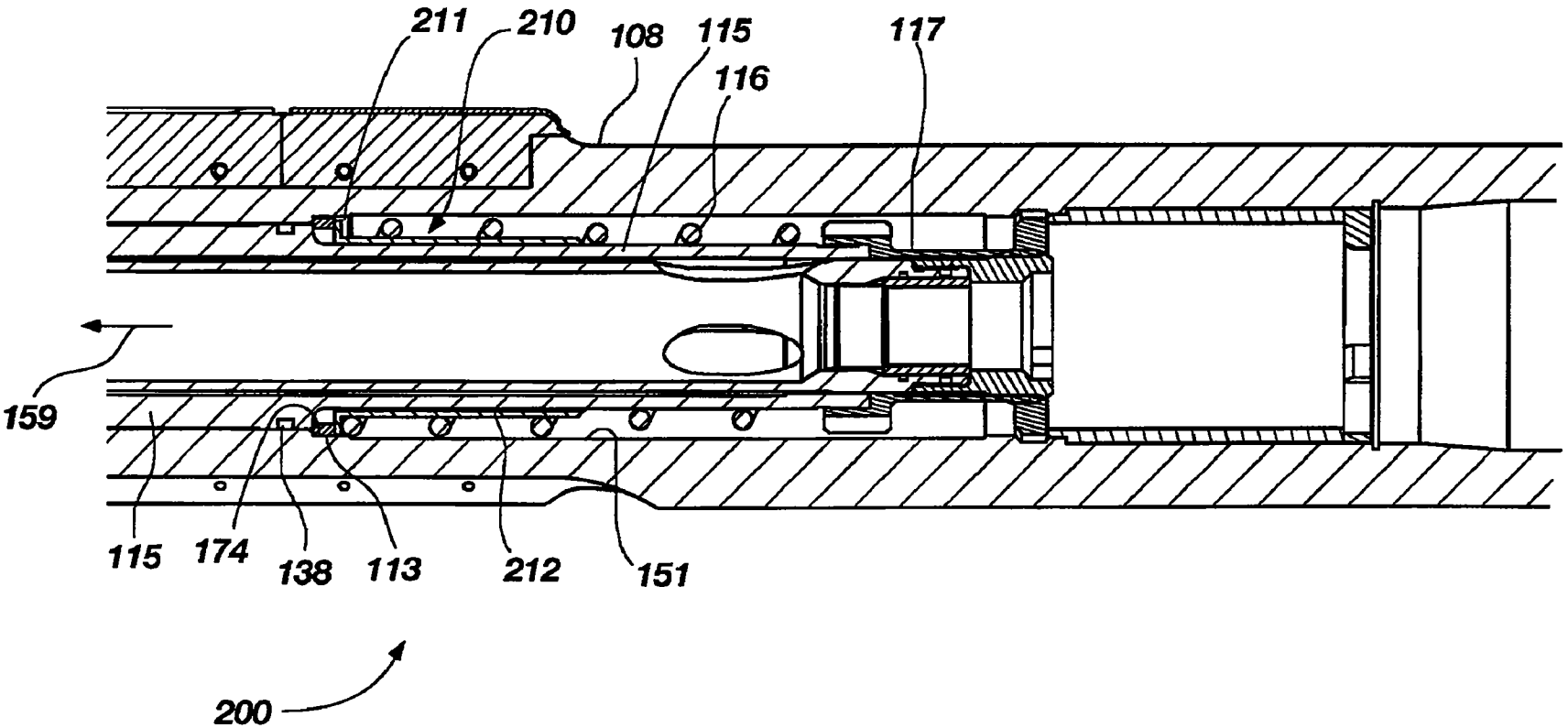
FIG. 25 illustrates a longitudinal cross-sectional view of one of many embodiments of an expandable reamer apparatus incorporating a motion-limiting member and utilizing certain aspects of the present inventions.

FIG. 25 shows a cross-sectional view of a motion-limiting member 210 for use with an expandable reamer apparatus 200 for limiting the extent to which blades may extend outwardly. As discussed above with respect to the stabilizer blocks 105 including a back stop for limiting the extent to which the blades may extend upwardly and outwardly along the blade tracks, the motion-limiting member 210 may be used to limit the extent in which the actuating means, i.e., the push sleeve 115, may extend in the axial uphole direction 159. The motion-limiting member 210 may have a cylindrical sleeve body 212 positioned between an outer surface of the push sleeve 115 and the inner bore 151 of the tubular body 108. As shown, the spring 116 may be located between the motion-limiting member 210 and the tubular body 108 while a base end 211 of the motion-limiting member 210 is retentively retained between the spring 116 and the retaining ring 113. When the push sleeve 115 is subjected to motion, for example, such as by hydraulic fluid pressure as described hereinabove, the spring 116 may be allowed to compress in the uphole direction 159 until, for example, its motion is arrested by the motion-limiting member 210 which prevents the spring 116 and the push sleeve 115 from further movement in the uphole direction 159. In this respect, the blades of the expandable reamer apparatus 200 may be prevented from extending beyond the limit set by the motion-limiting member 210.

Figure 26:
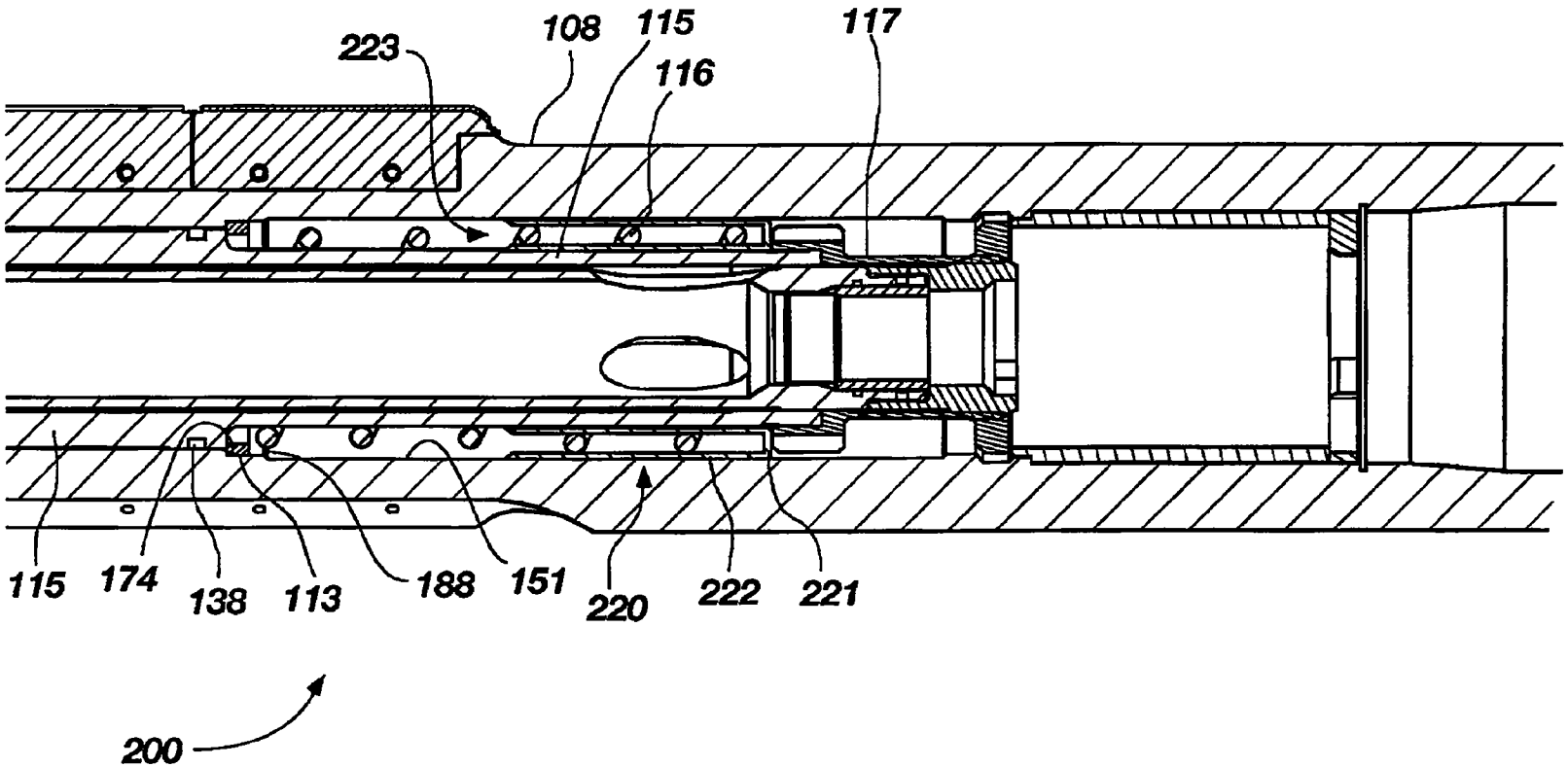
FIG. 26 illustrates a longitudinal cross-sectional view of one of many embodiments of an expandable reamer apparatus incorporating another motion-limiting member and utilizing certain aspects of the present inventions.

As shown in FIG. 26, another motion-limiting member 220 for use with an expandable reamer apparatus 200 may be configured with a spring box body 222 having an open cylindrical section 223 and a base end 221. A portion of the spring 116 may be contained within the open cylindrical section 223 of the spring box body 222 with the base end 221 resting between the spring 116 and an upper end of the lowlock sleeve 117. The motion of spring 116 and the push sleeve 115 may be arrested, for example, when the spring box body 222 is extended into impinging contact with the retaining ring 113 or a ledge or lip 188 located in the inner bore 151 of the tubular body 108.

While the motion-limiting members 210 and 220 (shown in FIGS. 25 and 26) are generally described as being cylindrical, they may have other shapes and configurations, for example, a pedestal, leg or elongated segment, without limitation. In a very broad sense, the motion-limiting member may allow the extent of axial movement to be arrested to varying degrees for an assortment of application uses, particularly when different boreholes are to be reamed with a common expandable reamer apparatus requiring only minor modifications thereto.

In other embodiments, the motion-limiting members 210 or 220 may be simple structures for limiting the extent to which the actuating means may extend to limit the motion of the blades. For example, a motion-limiting member may be a cylinder that floats within the space between the outer surface of the push sleeve 115 and the inner bore 151 of the tubular body 108 either between the spring 116 and the push sleeve 115 or the spring 116 and the tubular body 108, for example.

The expandable reamer apparatus 100, as described above with reference to FIGS. 1-23, may provide for robust actuation of the blades 101, 102, 103 along the same non-binding path (in either direction), which may be a substantial improvement over conventional reamers having a piston integral to the blades thereof to accumulate hydraulic pressure to operate it outward and thus requiring a differently located forcing mechanism such as springs to retract the blades back inward. In this respect, the expandable reamer apparatus may include activation means, i.e., the linkage assembly, the yoke, the push sleeve, and/or other components to be the same components for extending and retracting the blades, allowing the actuating force for moving the blades to lie along the same path, but in opposite directions. With conventional reamers, the actuation force to extend the blades may not be guaranteed to lie exactly in opposite directions and at least not along the same path, which may increase the probability of binding. The expandable reamer apparatus herein described may overcome deficiencies associated with conventional reamers.

In another aspect of the invention, the expandable reamer apparatus 100 drives the actuating means, i.e., the push sleeve, axially in a first direction while forcing the blades to move to the extended position (the blades being directly coupled to the push sleeve by a yoke and linkage assembly). In the opposite direction, the push sleeve directly retracts the blades by pulling, via the yoke and linkage assembly. Thus, activation means may provide for the direct extension and retraction of the blades, irrespective of the biasing spring or the hydraulic fluid, as conventionally provided.

Further embodiments of expandable reamer apparatus 100 will now be described, wherein elements common to those embodiments described above will keep the same numbering. As mentioned above, reamer 100 may include one or more components for reaming coupled to one or more of blades 101, 102, 103. While some reaming components may be configured to cut or remove material from the borehole, they need not be. Alternatively, reaming components may be configured to ream the borehole without removing material, by removing very little material or, as another example, by contacting the borehole wall only as required to center or stabilize equipment in accordance with a particular application, which may or may not include cutting, drilling, or other reaming processes, constantly, intermittently, collectively or otherwise. The embodiments described below function largely as those described above, the mechanics of the various embodiments being similar or identical except where otherwise indicated expressly, impliedly or otherwise. In the interest of efficiency and clarity, each structure or function relating to each embodiment will not be repeated below where such structure or function was described above, although references to the Figures above may be made from time to time in an effort to fully describe the inventions herein.

Figure 27:
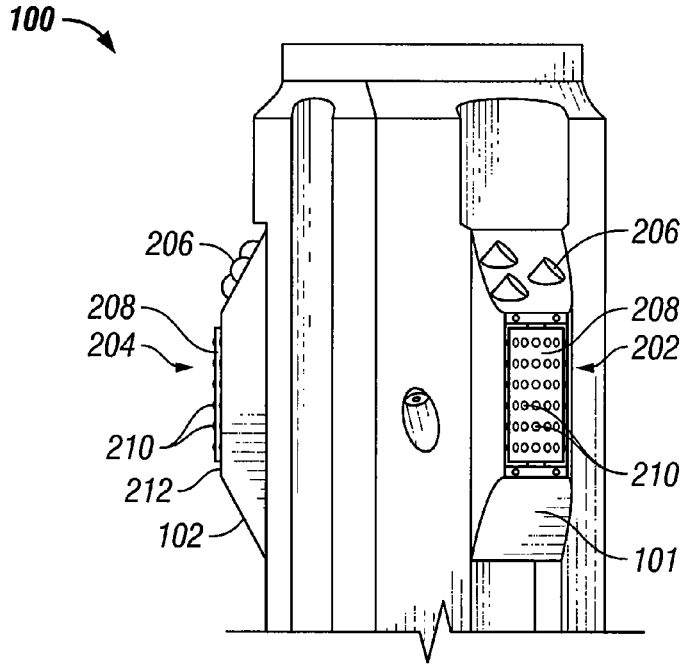
FIG. 27 illustrates one of many embodiments of the expandable reamer apparatus having rolling elements and utilizing certain aspects of the present invention.

FIG. 27 illustrates one of many embodiments of the expandable reamer apparatus 100 having rolling elements and utilizing certain aspects of the present invention. Unless otherwise indicated, the embodiment of FIG. 27 operates generally the same as those embodiments described herein above, wherein the differences are described in more detail below. The blades 101, 102, 103 (103*n* is not shown in FIG. 27) of reamer 100 may include rolling elements, such as roller reamer elements 202, 204. Each blade 101, 102, may include any number of roller elements 202, 204, and may preferably include one per blade. Each blade, 101, 102 may, but need not, include the one or more roller elements 202, 204 individually, or along with one or more other reaming components required by a particular application, such as, for example, one or more cutting elements, such as PDC cutters 206. Each roller element 202, 204 may include a body, such as roller body 208, which may preferably be cylindrical, but which could be any shape required by a particular application. The roller body 206 may be made of any material, such as a composite material, but may preferably be formed from steel. Roller body 206 may be smooth, contoured, textured or otherwise configured for reaming, such as having inserts, for example, one or more tungsten carbide buttons 210, or other inserts required by a particular application. Each roller element 202, 204 may be coupled to a blade 101, 102 so that at least a portion of the roller element, or an element coupled thereto, may extend radially outward relative to the radially outermost surface 212 of the associated blade 101, 102. For example, roller elements 202, 204 may be coupled such that they define the outermost, or expanded, diameter of reamer 100 when the reamer 100 is in the expanded state (see FIG. 22), or any state, including the retracted state (corresponding to a retracted diameter), such as to contact the wellbore during reaming, constantly, intermittently or otherwise.

Figure 28:
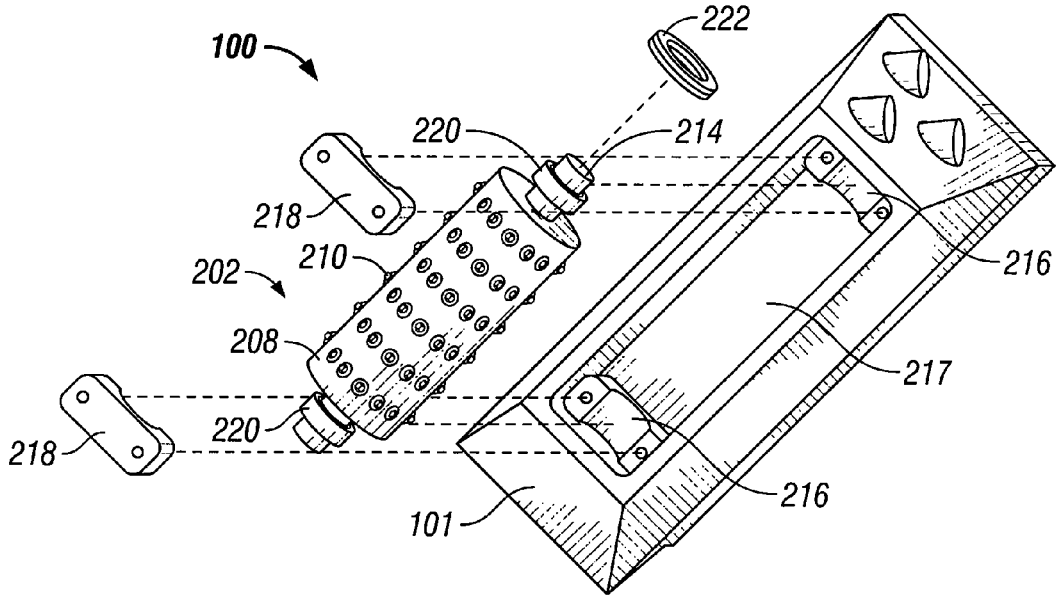
FIG. 28 illustrates another of many embodiments of the expandable reamer apparatus having rolling elements and utilizing certain aspects of the present invention.

FIG. 28 illustrates another of many embodiments of the expandable reamer apparatus 100 having rolling elements and utilizing certain aspects of the present invention. Each roller element 202 may be coupled to a blade 101 in any manner required by a particular application and may preferably be rotatably coupled thereto. As shown in the exemplary embodiment of FIG. 28, which is but one of many, roller element 202 may be disposed within the body of blade 101, in whole or in part. For example, roller body 208 may be coupled to shaft 214 and the combination thereof may be coupled to blade 101, such as to roller receptacles 216, for example. Roller retention plates 218 may be coupled to blade 101, for example, to secure roller element 202 in place. While retention plates 218 are shown to include holes for coupling purposes, such as for screws or bolts (not shown), it will be understood that roller element 202 may be coupled in any manner required by a particular application, such as, for example, by welding, friction, pinning or any method. Additionally, roller element 202 may be coupled to blade 101 to be easily removable or replaceable, but need not be. Roller element 202 may be any size relative to the size of block 101 or hole 217 in block 101 for receiving roller element 202. For example, the pocket or hole 217 may be just large enough to allow roller element 202 to rotate therein, which may include inserts 210. As another example, roller element 202 may be substantially smaller than hole 217, or any size, as required by a particular application. While one or more exemplary embodiments may use roller elements 202 having diameters such as one, two or, as another example, three inches, each roller element may be larger or smaller than these size, or any size in between. One of ordinary skill in the art will understand that each roller element 202 may be any size required by a particular application and that, while each roller element 202 may be the same size in a particular application, they need not be and the size may vary between one or more roller elements 202.

With further reference to FIG. 28, each roller element 202 may include one or more bearings, such as roller bearings 220, for rotation about the longitudinal axis of roller shaft 214. For example, roller element 202 may include a bearing 220 on each end, which may be coupled to shaft 214, as shown in FIG. 27 as an example, or which may be coupled in any manner that allows roller element 202 to rotate relative to blade 101. As other examples, bearings 220 may be coupled in or proximate to receptacles 216 or between shaft 214 and roller body 208, such as to allow roller body 208 to rotate about shaft 214 while shaft 214 remains substantially static. While bearings 220 regard rotation in the radial direction, roller element 202 may, but need not, include one or more bearings regarding the axial direction, such as thrust bearing 222, singularly or in combination with one or more radial bearings. For example, as reamer 100 moves up or down the wellbore, roller element 202 may be forced in the uphole or downhole direction and axial bearings, such as thrust bearing 222, may reduce friction between roller element 202 and blade 101, for example. It will be understood that thrust bearing 222 is shown in FIG. 28 for exemplary purposes only and that any bearing may be utilized, as required by a particular application, separately or in conjunction with other components in support of rotation, such as lubricants or copper beryllium pads, for example.

Figure 29:
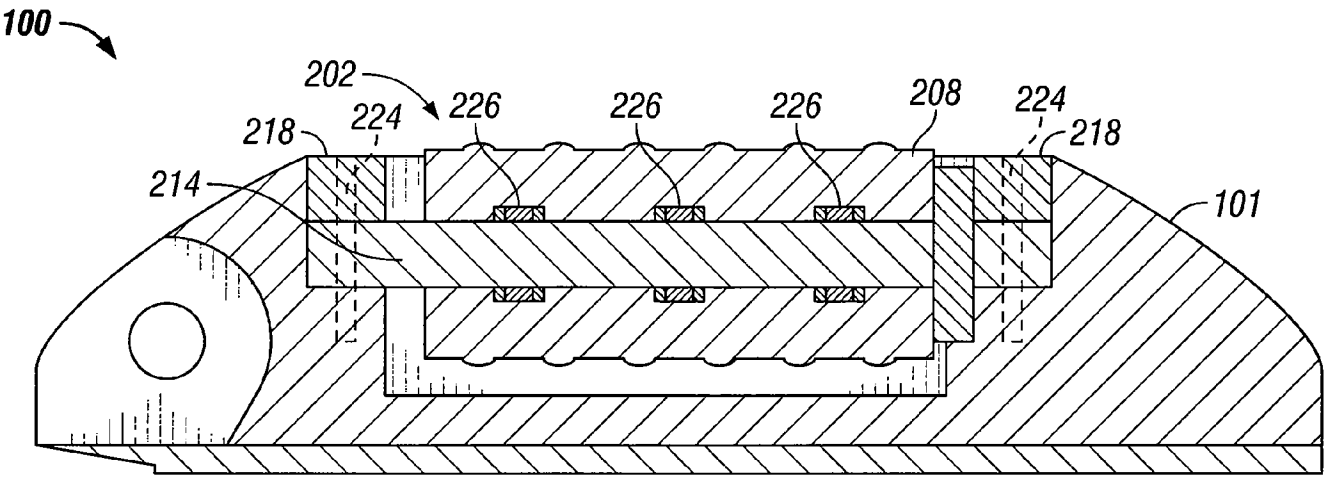
FIG. 29 illustrates one of many embodiments of an expandable reamer apparatus having a blade having a roller element and utilizing certain aspects of the present invention.

FIG. 29 illustrates one of many embodiments of an expandable reamer 100 having a blade 101 having a roller element 202 and utilizing certain aspects of the present invention. As discussed above, blade 101 may have a roller element 202 coupled thereto, which may include shaft 214, roller body 208, and/or other components for reaming. Roller element 202 may be coupled to, for example, slots in blade 101, which may include coupling retention plates 218 to block 101 for securing roller element 202 in position, such as parallel to the axis of the wellbore, parallel or angled relative to the outer surface of the block or to the track on which the block slides, or in any position required by a particular application. Retention plates 218 may, but need not, include holes 224, such as for screws, bolts, or pins (not shown) or alternatively may be coupled in any manner required by a particular application, for example, as described above. Additionally, roller element 202 may include components in support of rotation, such as, for example, bearings, which may include rotation in any direction, such as radially or longitudinally. As examples, bearings may be placed between roller body 208 and retention plates 218, between shaft 214 and blade 101, between roller body 208 and shaft 214, or in any location, singularly or in combination, as will be understood in the art. Three roller bearings 226 are shown in FIG. 29 for illustrative purposes only and one of ordinary skill will understand that the bearings may be of any type or size required by a particular application and they may be coupled in any location and in any manner. As examples, bearings 226 or 222 (FIG. 28) may be ball bearings, roller bearings, ball-thrust bearings, deep-groove ball bearings, or any type of bearings, made from any material, that may permit smooth, low-friction movement or other movement required by a particular application.

Figure 30:
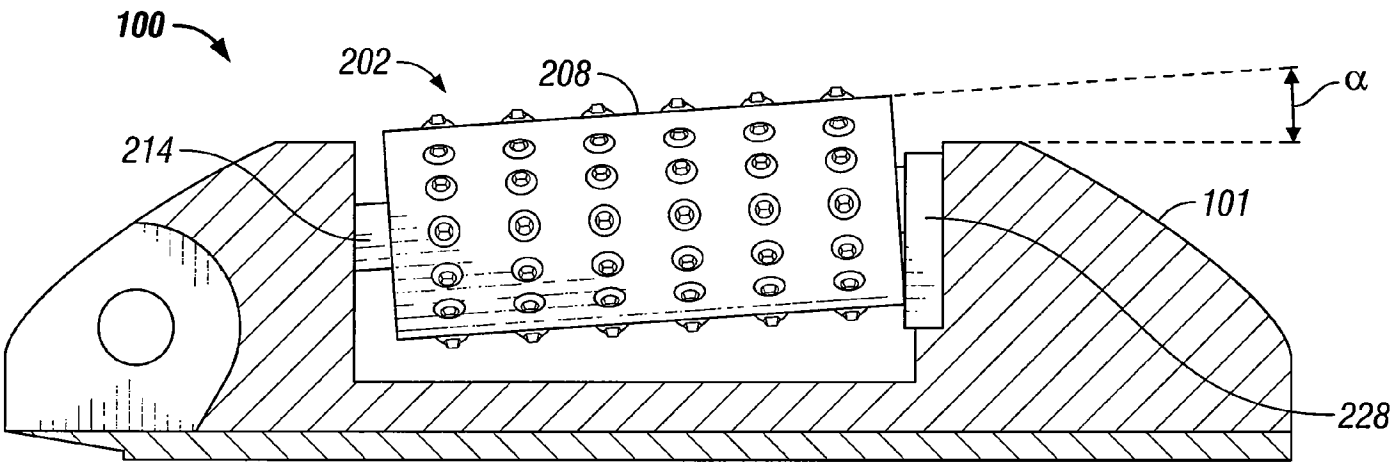
FIG. 30 illustrates another of many embodiments of an expandable reamer apparatus having a blade having an angled roller element and utilizing certain aspects of the present invention.

FIG. 30 illustrates another of many embodiments of an expandable reamer 100 having a blade 101 having an angled roller element 202 and utilizing certain aspects of the present invention. While roller element 202 is shown to be substantially parallel with the radially outermost surface of blade 101, it need not be. As illustrated in FIG. 30, roller element 202, may be askew from, or not parallel to, the outer surface of blade 101, or as another example, from the longitudinal axis of the wellbore, such as by an angle $\alpha$, for reaming a borehole as required by a particular application. In such an embodiment, which is but one of many, reaming the borehole may, but need not, include trimming or removing some amount of material from the borehole wall during operations. The angle $\alpha$ of deviation from the longitudinal axis of the wellbore may be chosen based on any number of factors, including but not limited to the diameters of the borehole before or after reaming, how much, if any, material may be trimmed or removed or, as another example, the aggressiveness of the configuration of the outer surface of the roller body 208, which may but need not include one or more inserts 210. As mentioned above with respect to one or more other embodiments, roller element 202 may include one or more bearings, such as, for example, thrust bearing 228, which may function alone or in conjunction with other bearings to support rotation of one or more components of roller element 202 and which may be coupled, for example, at either end of roller element 202, or another location as required by a particular application.

Figure 31:
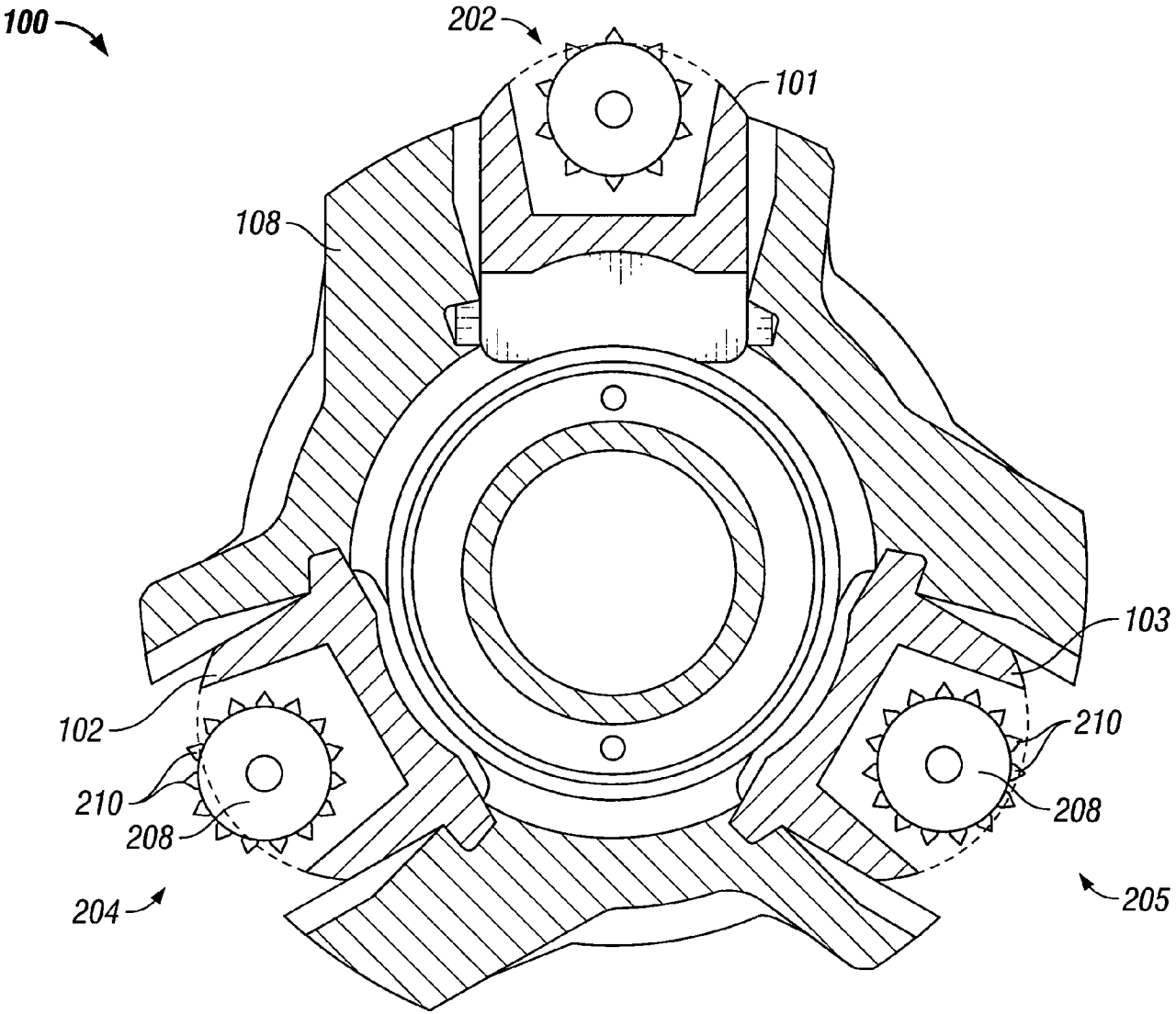
FIG. 31 illustrates another of many embodiments of the expandable reamer apparatus having roller elements and utilizing certain aspects of the present invention.

FIG. 31 illustrates another of many embodiments of the expandable reamer apparatus 100 having roller elements 202, 204, 205 and utilizing certain aspects of the present invention. Similarly to the description of FIG. 2 above, FIG. 31 shows blades 101, 102 and 103 having roller elements 202, 204, and 205, respectively, wherein blade 101 is shown in the outward or extended position. Blades 102 and 103 are shown in two more of many retracted positions. For example, blade 102 shows one retracted position wherein one or more inserts 210, in whole or in part, and at least a portion, such as the outer surface, of roller body 208 of roller element 204 extends beyond the radially outermost portion of the body of blade 102. As another example, blade 103 shows another retracted position wherein at least a portion of one or more inserts 210 extends beyond the radially outermost portion of the body of blade 103, but wherein the roller body 208 of roller element 205 remains radially inside of the body of blade 103. In the embodiment of roller element 204, for example, both the roller body 208 and one or more inserts 210 may contact the borehole wall during reaming operations. On the other hand, in the embodiment of roller element 205, one or more inserts 210, in whole or in part, may contact the borehole wall during reaming operations, but roller body 208 may not contact the borehole wall because the outer surface of roller body 208 may be disposed radially inside of the outermost portions of the body of blade 103. As mentioned above with respect to FIG. 2, the expandable reamer apparatus 100 may, but need not be configured such that the outermost radial or lateral extent of each of the blades 101, 102, 103 is recessed within the tubular body 108 when in the initial or retracted positions so that it may not extend beyond the greatest extent of outer diameter of the tubular body 108. Such an arrangement may protect the blades 101, 102, 103 as the expandable reamer apparatus 100 is disposed within a casing of a borehole, and may allow the expandable reamer apparatus 100 to pass through such casing within a borehole. In other embodiments, the outermost radial extent of the blades 101, 102, 103, including their respective roller elements 202, 204, 205 may coincide with or slightly extend beyond the outer diameter of the tubular body 108. As illustrated by blade 101, the blades may extend beyond the outer diameter of the tubular body 108 when in the extended position, to engage the walls of a borehole in a reaming operation. As illustrated by blades 102 and 103, the blades may, but need not, extend beyond the outer diameter of the tubular body 108 when in one or more retracted positions, such as to engage the walls of a borehole during reaming operations. For example, a particular application, but one of many, may require that two different diameters of boreholes be reamed, in the same or different wellbores. Accordingly, blades 101, 102, 103 having roller elements 202, 204, 205 may define a first reaming diameter, which may be greater or less than the outside diameter of tubular body 108, in the retracted position, and may define a second reaming diameter, such as a greater diameter, when reamer 100 is manipulated to the expanded position. As an example, a first reaming diameter, such as when blades 101, 102, 103 are retracted, may be about 10⅝ inches and a second reaming diameter, such as when blades 101, 102, 103 are expanded, may be about 12¼ inches. One of ordinary skill will understand that the reaming diameters may be any diameter required by a particular application, whether larger or smaller than those diameters discussed herein.

While particular embodiments of the invention have been shown and described, numerous variations and other embodiments will occur to those skilled in the art. Accordingly, it is intended that the invention only be limited in terms of the appended claims and their legal equivalents.

Other and further embodiments utilizing one or more aspects of the inventions described above can be devised without departing from the spirit of Applicant's invention. For example, the each blade may include cutters, stabilizing components, roller elements, or other components, in any combination. Further, the various methods and embodiments of the expandable reamer can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An expandable reamer apparatus for reaming a borehole in a subterranean formation, comprising:

a tubular body having a longitudinal axis, an inner bore, an outer surface, and at least one track within the tubular body between the inner bore and the outer surface, the at least one track sloped upwardly and outwardly at an acute angle to the longitudinal axis;

a drilling fluid flow path extending through the inner bore;

one or more blades, wherein at least one blade is slideably coupled to the at least one track of the tubular body and wherein the at least one blade has a roller element coupled thereto;

a push sleeve disposed within the inner bore of the tubular body and coupled to the at least one blade, the push sleeve configured to move axially upward responsive to a pressure of drilling fluid passing through the drilling fluid flow path to extend the at least one blade along the at least one track and into an extended position, the push sleeve having at least one retainment feature coupled thereto; and a traveling sleeve disposed at least partially within the push sleeve, the traveling sleeve configured to selectively retain the push sleeve in an initial position through contact with the at least one retainment feature coupled to the push sleeve.

2. The expandable reamer apparatus of claim 1, further comprising a biasing element disposed within the inner bore of the tubular body, in contact with the push sleeve and oriented to bias the push sleeve in an axially downward direction to retract the at least one blade along the at least one track and into a retracted position when the push sleeve is not subjected to force or pressure of drilling fluid sufficient to overcome a force provided by the biasing element.

3. The expandable reamer apparatus of claim 1, wherein the at least one track extends radially outwardly from the longitudinal axis.

4. The expandable reamer apparatus of claim 1, wherein the acute angle is about 10 degrees.

5. The expandable reamer apparatus of claim 1, wherein the acute angle is less than about 35 degrees.

6. The expandable reamer apparatus of claim 1, wherein the at least one blade is directly coupled to the push sleeve by a linkage assembly.

7. The expandable reamer apparatus of claim 1, further including a guide structure for positionally retaining and guiding the at least one blade within the at least one track.

8. The expandable reamer apparatus of claim 7, wherein the guide structure comprises two opposed dovetail-shaped rails on the at least one blade and two dovetail-shaped grooves on opposing sides of the at least one track matingly slidably receiving the dovetail-shaped rails.

9. The expandable reamer apparatus of claim 1, further comprising a motion-limiting member coupled between the tubular body and the push sleeve to limit the axial extent of the push sleeve.

10. The expandable reamer apparatus of claim 1, wherein the traveling sleeve is axially retained in the initial position by a shear assembly within the inner bore of the tubular body.

11. The expandable reamer apparatus of claim 1, further comprising a lowlock sleeve coupled to the push sleeve, a portion of the lowlock sleeve forming the at least one retainment feature, wherein the push sleeve is axially retained in the initial position by the at least one retainment feature of the lowlock sleeve when the at least one retainment feature of the lowlock sleeve is engaged with the tubular body proximate to a lower end of the traveling sleeve, and wherein the push sleeve is axially transitionable after the traveling sleeve has axially transitioned sufficiently to release the at least one retainment feature of the lowlock sleeve from engagement with the tubular body.

12. The expandable reamer apparatus of claim 1, further comprising an uplock sleeve for axially retaining the traveling sleeve upon sufficient travel within the tubular body.

13. The expandable reamer apparatus of claim 1, further comprising a measurement device for determining a diameter of the enlarged borehole.

14. The expandable reamer apparatus of claim 13, wherein the measurement device is a sonic caliper directed substantially perpendicular to the longitudinal axis for measuring a distance to the wall of the enlarged borehole.

15. The expandable reamer apparatus of claim 1, further comprising a stabilizer sleeve coupled to the inner bore of a lower end of the tubular body for receiving a lower end of the traveling sleeve.

16. An expandable reamer apparatus for reaming a borehole in a subterranean formation, comprising:

a tubular body having a longitudinal axis, an inner bore, an outer surface, a plurality of upwardly and outwardly sloping tracks within the tubular body between the inner bore and the outer surface at an acute angle to the longitudinal axis;

a drilling fluid flow path extending through the tubular body for conducting drilling fluid therethrough;

a plurality of circumferentially spaced, generally radially and longitudinally extending blades, each blade slidably engaged with one of the plurality of tracks, carrying at least one roller element thereon and movable along its associated track between an extended position and a retracted position;

an actuation structure positioned within the tubular body and configured to directly effect movement of the blades in the tracks from the retracted position to the expanded position responsive to a pressure of drilling fluid within the flow path and an opposing force;

a lowlock sleeve coupled to the actuation structure; and a traveling sleeve disposed at least partially within the tubular body, wherein a portion of the traveling sleeve abuts a portion of the lowlock sleeve to selectively retain the actuation structure in an initial position and wherein axial translation of the traveling sleeve enables the lowlock sleeve and the actuation structure to axially translate within the tubular body.

17. The expandable reamer apparatus of claim 16, wherein the force is a biasing force provided by a structure oriented substantially inline with the longitudinal axis and in contact with the actuation structure for holding the blades at the retracted position in the tracks with the force, the retracted position corresponding to no more than an initial diameter of the expandable reamer apparatus.

18. The expandable reamer apparatus of claim 17, wherein the biasing force is effected by a spring structure.

19. The expandable reamer apparatus of claim 16, further comprising structure for selectively limiting the movement of the blades along the tracks beyond the extended position corresponding to an expanded diameter of the expandable reamer apparatus.

20. The expandable reamer apparatus of claim 16, wherein the actuation structure is selectively operably responsive to drilling fluid pressure within the inner bore.

21. The expandable reamer apparatus of claim 16, wherein the at least one roller element defines a radially outermost reaming diameter of the reamer when the blade carrying the at least one roller element is in one or more positions.

22. The expandable reamer apparatus of claim 16, wherein:

the traveling sleeve comprises a reduced cross-sectional area orifice sized and configured to receive a restriction element therein for developing axial force upon the traveling sleeve responsive to drilling fluid flowing therethrough;

the initial position of the traveling sleeve prevents the actuation structure from moving the blades beyond the initial position; and a triggered position of the traveling sleeve allows drilling fluid to directly move the blades in the tracks.

23. The expandable reamer apparatus of claim 22, wherein the restriction element comprises a ball sized and configured to engage the traveling sleeve at a seating surface complementarily sized and configured to substantially prevent the flow of drilling fluid therethrough and to cause displacement of the traveling sleeve within the expandable reamer to a position that releases the actuating structure for movement.

24. The expandable reamer apparatus of claim 16, wherein an outermost extended position of the movable blades is adjustable.

25. The expandable reamer apparatus of claim 16, further comprising a replaceable stabilizing block disposed proximate to one longitudinal end of the tracks to limit the extent of outward movement of the movable blades therein.

26. An expandable reamer apparatus for reaming a borehole in a subterranean formation, comprising:

a tubular body having a longitudinal axis, an outer surface, and a track within the tubular body, the track sloped upwardly and outwardly at an acute angle to the longitudinal axis;

a drilling fluid flow path extending through an inner bore of the tubular body;

a blade having at least one roller element configured to remove material from a subterranean formation during reaming and slideably coupled to the track;

a push sleeve disposed within the inner bore of the tubular body and directly coupled to the blade, the push sleeve configured to move axially upward responsive to a pressure of drilling fluid passing through the inner bore to extend the blade along the track;

a traveling sleeve disposed at least partially within an inner bore of the push sleeve; and a lowlock sleeve coupled to the push sleeve, wherein a portion of the traveling sleeve forces a portion of the lowlock sleeve into engagement with an inner portion of the tubular body to retain the push sleeve in an initial position and wherein axial translation of the traveling sleeve enables the lowlock sleeve to disengage from the tubular body.

27. The expandable reamer apparatus of claim 26, further comprising a compression spring disposed within the inner bore of the tubular body and in contact with the push sleeve for biasing the push sleeve toward a retracted position.

28. The expandable reamer apparatus of claim 26, further comprising a motion-limiting member coupled between the tubular body and the push sleeve to limit an extent of axial movement of the push sleeve.

29. An expandable reamer apparatus for reaming a borehole in a subterranean formation, comprising:

a tubular body having a longitudinal axis and at least one track within a wall of the tubular body sloped upwardly and outwardly at an acute angle to the longitudinal axis;

a drilling fluid flow path extending through an inner bore of the tubular body;

at least one blade having at least one roller element configured to ream the subterranean formation, the at least one blade slideably coupled to the at least one track;

a push sleeve disposed within the inner bore of the tubular body and directly coupled to the at least one blade, the push sleeve configured to move axially upward responsive to a pressure of drilling fluid passing through the inner bore to extend the at least one blade along the at least one track;

a traveling sleeve within the tubular body axially retaining the push sleeve in an initial position within the tubular body by engaging at least one retainment feature coupled to the push sleeve;

a longitudinal biasing element disposed within the inner bore of the tubular body and in contact with the push sleeve; and a motion-limiting member coupled between the tubular body and the push sleeve to limit an extent of axial movement of the push sleeve responsive to the pressure.

30. The expandable reamer apparatus of claim 29, wherein the traveling sleeve is axially retained in the initial position by a shear assembly within the inner bore of the tubular body.

31. The expandable reamer apparatus of claim 29, wherein the motion-limiting member floats with motion of the biasing element while limiting the extent of axial movement of the push sleeve.

32. An expandable reamer for reaming a borehole in a subterranean formation, comprising:

a body having a longitudinal axis;

a drilling fluid flow path extending through the body for conducting drilling fluid therethrough;

a plurality of blades carried by the body at an acute angle relative to the longitudinal axis, each blade having at least one roller element coupled thereto;

an actuator positioned within the body and configured to directly actuate the plurality of blades between an extended position and a retracted position in respective response to a pressure provided by the drilling fluid within the flow path and an opposing force;

a traveling sleeve disposed at least partially within the body, the traveling sleeve configured to selectively retain the actuator in an initial position; and a lowlock assembly including a plurality of protrusions, wherein a portion of the traveling sleeve forces the plurality of protrusions of the lowlock assembly into engagement with an inner portion of the tubular body and wherein axial translation of the traveling sleeve enables the plurality of protrusions of the lowlock sleeve to disengage from the inner portion of the tubular body enabling the actuator to axially translate within the tubular body.

33. The expandable reamer of claim 32, further comprising at least one biasing element coupled to the actuator for providing the opposing force and further including structure for selectively limiting movement of the plurality of blades beyond an outermost extended position corresponding to an expanded diameter of the expandable reamer apparatus.

34. The expandable reamer of claim 33, wherein each roller element is a cylindrical roller element coupled to the corresponding blade so that at least a portion of each of the plurality of roller elements collectively defines the expanded diameter so that each roller element rotates about its longitudinal axis when the roller element contacts the borehole while the reamer is in the expanded position.

35. The expandable reamer of claim 34, wherein an outer surface of at least one roller element is at least partially smooth.

36. The expandable reamer of claim 34, wherein an outer surface of at least one roller element has inserts coupled thereto.

37. The expandable reamer of claim 32, wherein the retracted position corresponds to a retracted diameter and wherein each roller element is a cylindrical roller element coupled to the corresponding blade so that at least a portion of each of the plurality of roller elements collectively defines the retracted diameter so that each roller element rotates about its longitudinal axis when the roller element contacts the borehole while the reamer is in the retracted position.

38. The expandable reamer of claim 32, wherein a longitudinal axis of at least one roller element is parallel to a longitudinal axis of the borehole during reaming.

39. The expandable reamer of claim 32, wherein a longitudinal axis of at least one roller element is not parallel to a longitudinal axis of the borehole during reaming.

40. The expandable reamer of claim 32, wherein at least one roller element has an outer surface having a plurality of inserts coupled thereto, and wherein the at least one roller element is coupled to a corresponding blade so that at least a portion of one of the plurality of inserts contacts the borehole during reaming.

41. The expandable reamer of claim 32, wherein at least one roller element has an outer surface having a plurality of inserts coupled thereto, and wherein the at least one roller element is coupled to a corresponding blade so that at least one of the plurality of inserts and at least a portion of the outer surface of the at least one roller element contact the borehole during reaming.

* * * * *